US007516954B2

(12) United States Patent
Hattori

(10) Patent No.: US 7,516,954 B2
(45) Date of Patent: Apr. 14, 2009

(54) SHEET SUPPLYING DEVICE

(75) Inventor: Makoto Hattori, Nagoya (JP)

(73) Assignee: Brother Kogyo Kabushiki Kaisha (JP)

( * ) Notice: Subject to any disclaimer, the term of this patent is extended or adjusted under 35 U.S.C. 154(b) by 355 days.

(21) Appl. No.: 11/236,559

(22) Filed: Sep. 28, 2005

(65) Prior Publication Data

US 2006/0180987 A1 Aug. 17, 2006

(30) Foreign Application Priority Data

Sep. 28, 2004 (JP) ..... 2004-282580

(51) Int. Cl.
*B65H 3/52* (2006.01)

(52) U.S. Cl. ..... 271/121; 271/117

(58) Field of Classification Search ..... 271/121, 271/109, 117, 169
See application file for complete search history.

(56) References Cited

U.S. PATENT DOCUMENTS

| | | | | |
|---|---|---|---|---|
| 5,927,703 | A * | 7/1999 | Endo | 271/10.03 |
| 6,338,480 | B1 * | 1/2002 | Endo | 271/104 |
| 6,543,761 | B2 * | 4/2003 | Endo | 271/110 |
| 7,210,677 | B2 * | 5/2007 | Fukumura et al. | 271/10.01 |

FOREIGN PATENT DOCUMENTS

| | | |
|---|---|---|
| JP | 2048974 | 1/1990 |
| JP | 2-48974 A | 2/1990 |
| JP | 2003-128283 A | 5/2003 |

OTHER PUBLICATIONS

JP Office Action mailed Dec. 4, 2007, JP Appln. No. 2004-282580.

* cited by examiner

*Primary Examiner*—Kaitlin S Joerger
(74) *Attorney, Agent, or Firm*—Banner & Witcoff, ltd.

(57) ABSTRACT

A shifting mechanism shifts at least one of a sheet accommodating portion and feeding portion, thereby changing a position of the feeding portion relative to sheets. A pressure changing mechanism changes pressure between first and second separating portions. A contact force controlling portion controls the shifting mechanism to provide a first contact force when the feeding portion starts a feeding operation, and controls the shifting mechanism, at a first timing, to reduce the contact force from the first contact force to a second contact force. A pressure controlling portion controls the pressure changing mechanism to provide a first pressure between the first and second separating portions when the feeding portion starts the feeding operation, and controls the pressure changing mechanism, at a second timing, to reduce the pressure from the first pressure to a second pressure while nipping the separated sheet between the first and second separating portions.

15 Claims, 13 Drawing Sheets

SHEET SUPPLYING DEVICE

BACKGROUND OF THE INVENTION

1. Field of the Invention

The present invention relates to a sheet supplying device for separating and supplying sheets of a recording medium one sheet at a time. The present invention also relates to an image forming apparatus equipped with the sheet supplying device.

2. Description of Related Art

Japanese examined patent-application publication No. HEI-8-13565 (Japanese unexamined patent-application publication No. HEI-2-48974) describes a conventional paper-feeding mechanism having a feeding roller that rotates in contact with the surface of stacked sheets of paper in order to feed the sheets of paper, and a separating roller that rotates to convey the paper one sheet at a time as the paper supplied by the feeding roller becomes interposed between the separating roller and a friction pad. When conveying rollers positioned downstream of the separating roller receive and begin to convey the paper, the feeding roller is lifted and separated from the stacked sheets of paper, and the friction pad is also separated from the separating roller, thereby reducing the resistance (back tension) on the sheet of paper after separation. In another example, both a feeding roller and a separating roller have D-shaped cross sections. The rotations of the feeding roller and the separating roller are synchronized so that the flat parts on the surfaces of both rollers confront and do not contact the surface of the paper when the conveying rollers receive and begin to convey the paper, thereby reducing the resistance (back tension) on the sheet of paper after separation.

SUMMARY

However, when the desired first sheet of paper is being conveyed, the second sheet and subsequent sheets may be pulled along with the first sheet if the paper is wrinkled or if static electricity is present between the sheets of paper, for example. In the conventional constructions described above, the friction pad and separating roller are separated at the time the paper is conveyed to the conveying rollers. Hence, the separating function of the friction pad and separating roller is no longer effective from this point, allowing the second sheet or subsequent sheets of paper to be conveyed along with the first sheet.

In view of the foregoing, it is an object of the present invention to provide a sheet supplying device capable of reliably separating and conveying a recording medium one sheet at a time, and an image forming apparatus provided with the sheet supplying device.

In order to attain the above and other objects, according to one aspect, the present invention provides a sheet supplying device. The sheet supplying device includes a sheet accommodating portion, a feeding portion, a shifting mechanism, a first separating portion, a second separating portion, a pressure changing mechanism, a contact force controlling portion, and a pressure controlling portion. The sheet accommodating portion accommodates a plurality of sheets in a stacked arrangement. The feeding portion is disposed to be contactable with a topmost sheet of the plurality of sheets with contact force and is rotatable in contact with the topmost sheet for conveying the topmost sheet downstream in a conveying direction. The shifting mechanism shifts at least one of the sheet accommodating portion and the feeding portion, thereby changing a position of the feeding portion relative to the plurality of sheets in the sheet accommodating portion. The first separating portion is disposed downstream of the feeding portion in the conveying direction. The second separating portion is disposed to be pressed against the first separating portion. The second separating portion is rotatable to separate the topmost sheet from other sheets of the plurality of sheets in cooperation with the first separating portion and to convey the separated sheet in the conveying direction. The pressure changing mechanism changes pressure between the first separating portion and the second separating portion. The contact force controlling portion controls the shifting mechanism to provide a first contact force when the feeding portion starts a feeding operation for conveying the topmost sheet in the conveying direction, and controls the shifting mechanism, at a first timing, to reduce the contact force from the first contact force to a second contact force. The pressure controlling portion controls the pressure changing mechanism to provide a first pressure between the first separating portion and the second separating portion when the feeding portion starts the feeding operation, and controls the pressure changing mechanism, at a second timing, to reduce the pressure from the first pressure to a second pressure while nipping the separated sheet between the first separating portion and the second separating portion.

The sheet may refer to a sheet of paper or a transparency sheet used as a recording medium or may refer to a sheet that is not a recording medium, such as a paper currency.

The sheet supplying device may be a device that is detachably mounted in the body of an image forming apparatus, such as a printer or facsimile device, or a multifunction device having a printer function, scanner function, and the like. The sheet supplying device may also be non-detachably provided in the body of the image forming apparatus. Further, the sheet supplying device is not limited to the function of providing sheets of a recording medium into the image forming apparatus, but may also be provided in a device used to count sheets, such as sheets of a paper currency.

The shifting mechanism may be configured to shift only the feeding portion, only the sheet accommodating portion, or both the feeding portion and the sheet accommodating portion.

The pressure changing mechanism is configured to adjust the pressure between the first separating portion and the second separating portion by shifting only the first separating portion, only the second separating portion, or both the first separating portion and the second separating portion. The pressure changing mechanism may also be configured to press at least one of the first separating portion and the second separating portion through urging force of an urging member and to adjust the urging force.

The action of reducing the contact force includes not only reducing the contact force while maintaining a state of contact, but also separating the feeding portion from the sheets.

According to another aspect of the present invention, the feeding portion and the second separating portion are configured of a common roller that is capable of contacting the surface of the sheets accommodated in the sheet accommodating portion and capable of contacting the first separating portion with pressure.

The urging member includes an elastic member such as a spring or rubber member.

The pressure changing mechanism may either be configured to shift an end of the urging member opposite the end that contacts the first separating portion, or may be configured to shift the second separating portion.

The driving source may be housed in the sheet supplying device or may be provided outside of the sheet supplying device.

According to another aspect, the present invention provides an image forming apparatus. The image forming apparatus includes a sheet supplying device and an image forming unit. The sheet supplying device includes a sheet accommodating portion, a feeding portion, a shifting mechanism, a first separating portion, a second separating portion, a pressure changing mechanism, a contact force controlling portion, and a pressure controlling portion. The sheet accommodating portion accommodates a plurality of sheets in a stacked arrangement. The feeding portion is disposed to be contactable with a topmost sheet of the plurality of sheets with contact force and is rotatable in contact with the topmost sheet for conveying the topmost sheet downstream in a conveying direction. The shifting mechanism shifts at least one of the sheet accommodating portion and the feeding portion, thereby changing a position of the feeding portion relative to the plurality of sheets in the sheet accommodating portion. The first separating portion is disposed downstream of the feeding portion in the conveying direction. The second separating portion is disposed to be pressed against the first separating portion. The second separating portion is rotatable to separate the topmost sheet from other sheets of the plurality of sheets in cooperation with the first separating portion and to convey the separated sheet in the conveying direction. The pressure changing mechanism changes pressure between the first separating portion and the second separating portion. The contact force controlling portion controls the shifting mechanism to provide a first contact force when the feeding portion starts a feeding operation for conveying the topmost sheet in the conveying direction, and controls the shifting mechanism, at a first timing, to reduce the contact force from the first contact force to a second contact force. The pressure controlling portion controls the pressure changing mechanism to provide a first pressure between the first separating portion and the second separating portion when the feeding portion starts the feeding operation, and controls the pressure changing mechanism, at a second timing, to reduce the pressure from the first pressure to a second pressure while nipping the separated sheet between the first separating portion and the second separating portion. The image forming unit forms an image on the sheet supplied from the sheet supplying device.

In addition to a printing device such as a laser printer, the image forming apparatus may also be a facsimile device or a multifunction device provided with a printer function, a scanner function, and the like. The image forming apparatus is also not limited to a tandem apparatus having an image bearing member for each developing unit, but may be a device that employs a transfer system, an intermediate transfer system, or a single-pass system in which each developing unit develops and forms images on a common image bearing member.

BRIEF DESCRIPTION OF THE DRAWINGS

The above and other objects, features and advantages of the invention will become more apparent from reading the following description of the embodiments taken in connection with the accompanying drawings in which.

DETAILED DESCRIPTION OF THE EMBODIMENTS

A sheet supplying device and an image forming apparatus according to an embodiment of the present invention will be described while referring to the accompanying drawings. In the following description, the expressions "front", "rear", "right", and "left" are used to define the various parts when the image forming apparatus is disposed in an orientation in which it is intended to be used.

1. Overall Structure of the Image Forming Apparatus

Figure 1:
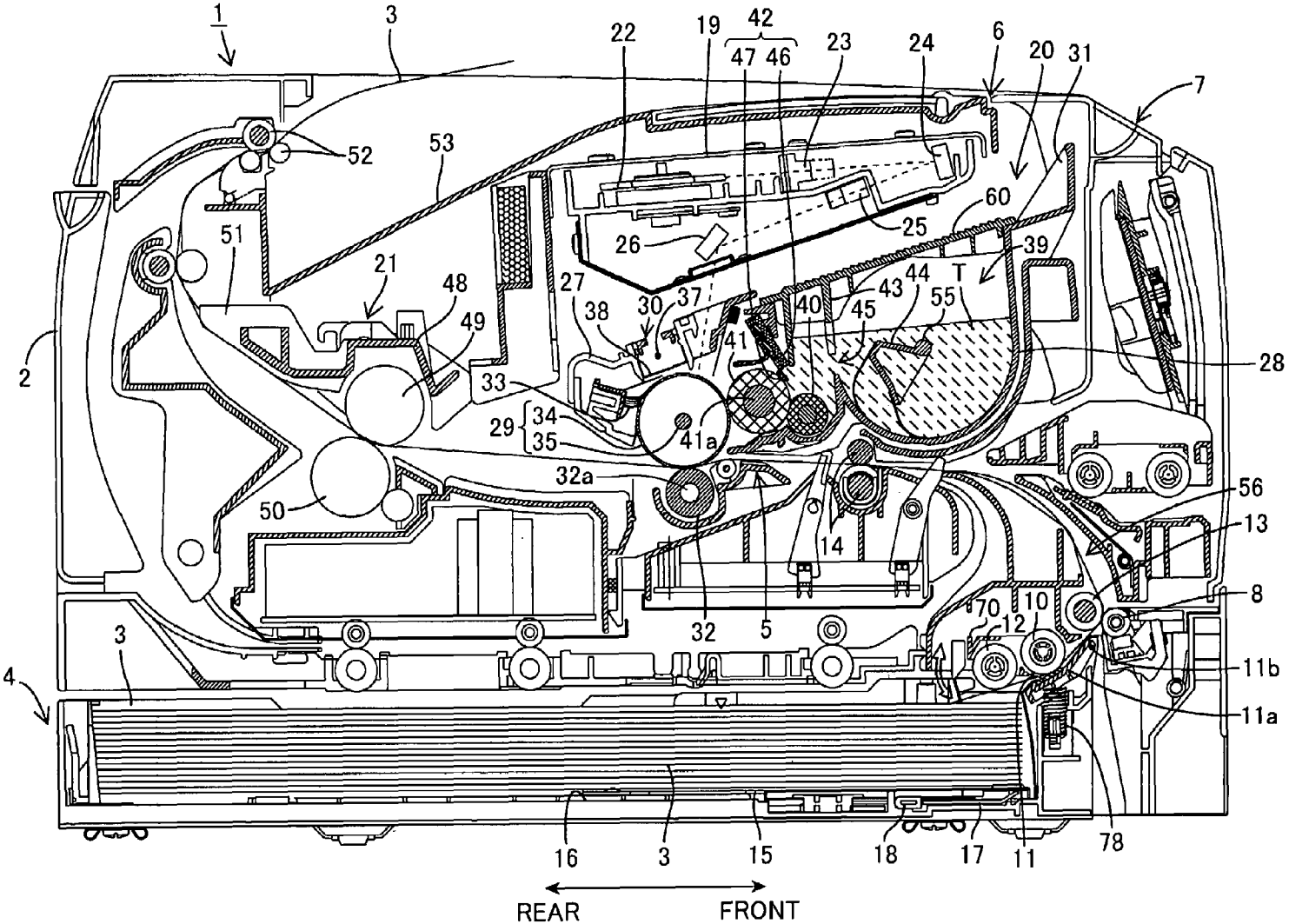
FIG. 1 is a side cross-sectional view of a laser printer according to an embodiment of the present invention.

FIG. 1 is a side cross-sectional view of a laser printer 1. As shown in FIG. 1, the laser printer 1 includes a main casing 2 and, within the main casing 2, a feeding unit 4 for supplying sheets of a paper 3, an image forming unit 5 for forming images on the paper 3 supplied by the feeding unit 4, and the like.

(1) Main Casing

An access opening 6 formed in one side wall of the main casing 2 for inserting and removing a process cartridge 20 described later, and a front cover 7 capable of opening and closing over the access opening 6. The front cover 7 is pivotally supported by a cover shaft (not shown) inserted through a bottom end of the front cover 7. Accordingly, when the front cover 7 is pivotally closed about the cover shaft, the front cover 7 covers the access opening 6 as shown in FIG. 1. When the cover is pivotally open about the cover shaft (pivotally moved downward), the access opening 6 is exposed, enabling the process cartridge 20 to be mounted into or removed from the main casing 2 via the access opening 6.

In the description below, the side of the laser printer 1 and the process cartridge 20 on which the front cover 7 is provided will be referred to as the "front side" and the opposite side as the "rear side," when the process cartridge 20 is mounted in the main casing 2.

(2) Feeding Unit

The feeding unit 4 includes a paper supply tray 9 that is detachably mounted in a lower section of the main casing 2, a separating roller 10 and a separating pad 11 disposed above the front end of the paper supply tray 9, and a feeding roller 12 disposed on the rear side of the separating roller 10 (upstream of the separating pad 11 with respect to the conveying direction of the paper 3). The feeding unit 4 also includes a paper dust roller 8 disposed above and forward of the separating roller 10 downstream of the separating roller 10 in the paper-conveying direction, and an opposing roller 13 disposed in opposition to the paper dust roller 8.

A U-shaped section of the paper-conveying path 56 reverses directions toward the rear end of the laser printer 1, forming a U-shape near the paper dust roller 8. A pair of registration rollers 14 is disposed below the process cartridge 20 farther downstream of the U-shaped section of the paper-conveying path 56 with respect to the paper-conveying direction.

A paper-pressing plate 15 is provided inside the paper supply tray 9 for supporting the paper 3 in a stacked state. The paper-pressing plate 15 is pivotably supported on the rear end thereof, so that the front end can pivot downward to a resting position in which the paper-pressing plate 15 rests on a bottom plate 16 of the paper supply tray 9 (as shown in FIG. 1) and can pivot upward to a supplying position in which the paper-pressing plate 15 slopes upward from the rear end to the front end (as shown in FIGS. 10-13).

A lever 17 is provided in the front section of the paper supply tray 9 for lifting the front end of the paper-pressing plate 15 upward. The rear end of the lever 17 is pivotally supported on a lever shaft 18 at a position below the front end of the paper-pressing plate 15 so that the front end of the lever 17 can pivot between a level position (shown in FIG. 1) in which the lever 17 lies along the bottom plate 16 of the paper supply tray 9 and a sloped position (shown in FIGS. 10-13) in which the front end of the lever 17 lifts the paper-pressing plate 15 upward. When a clockwise (FIG. 1) rotational driving force is inputted into the lever shaft 18, the lever 17 pivotally moves about the lever shaft 18 and the front end of the lever 17 raises the front end of the paper-pressing plate 15, shifting the paper-pressing plate 15 into the supplying position.

When the paper-pressing plate 15 is in the supplying position, the topmost sheet of the paper 3 stacked on the paper-pressing plate 15 is pressed against the feeding roller 12. The rotating feeding roller 12 begins feeding this topmost sheet of paper 3 toward a separated position between the separating roller 10 and separating pad 11.

When the paper supply tray 9 is removed from the main casing 2, the front end of the paper-pressing plate 15 drops downward due to its own weight, moving the paper-pressing plate 15 into the resting position. While the paper-pressing plate 15 is in the resting position, the paper 3 can be stacked on the paper-pressing plate 15. With this construction, the separating pad 11, paper dust roller 8, paper-pressing plate 15, and lever 17 are provided on the paper supply tray 9, while the feeding roller 12, separating roller 10, opposing roller 13, and registration rollers 14 are provided on the main casing 2.

When the feeding roller 12 conveys a sheet of the paper 3 toward the separated position and the sheet becomes interposed between the separating roller 10 and the separating pad 11, the rotating separating roller 10 can separate and supply the paper 3 one sheet at a time. The sheets of paper 3 supplied by the separating roller 10 travel along the U-shaped paper-conveying path 56. Hence, the sheets of paper 3 reverse directions and are conveyed toward the rear end of the laser printer 1. More specifically, the feeding roller 12 conveys a sheet of the paper 3 between the separating roller 10 and separating pad 11 to the paper dust roller 8 and opposing roller 13. The paper dust roller 8 and opposing roller 13 convey the paper 3 to the registration rollers 14 while removing paper dust from the paper 3 as the paper 3 passes therebetween.

After registering the paper 3, the registration rollers 14 convey the paper 3 to a transfer position between a photosensitive drum 29 and a transfer roller 32 described later at which a toner image formed on the photosensitive drum 29 is transferred onto the paper 3.

(3) Image Forming Unit

The image forming unit 5 includes a scanning unit 19, the process cartridge 20, a fixing unit 21, and the like.

(a) Scanning Unit

The scanning unit 19 is disposed in the top section of the main casing 2 and includes a laser light source (not shown), a polygon mirror 22 that can be driven to rotate, an fθ lens 23, a reflecting mirror 24, a lens 25, a reflecting mirror 26, and the like. The laser light source emits a laser beam based on image data. As illustrated by a dotted line in FIG. 1, the laser beam is deflected by the polygon mirror 22, passes through the fθ lens 23, is reflected by the reflecting mirror 24, passes through the lens 25, and is reflected downward by the reflecting mirror 26 to be irradiated on the surface of the photosensitive drum 29 described later in the process cartridge 20.

(b) Process cartridge

The process cartridge 20 is detachably mounted in the main casing 2 beneath the scanning unit 19. The process cartridge 20 includes an upper frame 27, and a lower frame 28 formed separately from the upper frame 27 and assembled therewith to form a casing. Within this casing, the process cartridge 20 is also provided with the photosensitive drum 29, a Scorotron charger 30, a developing cartridge 31, the transfer roller 32, and a cleaning brush 33.

The photosensitive drum 29 includes a main drum body 34 that is cylindrical in shape and has a positive charging photosensitive layer formed of polycarbonate or the like on its outer surface, and a metal drum shaft 35 extending along the axial center of the main drum body 34 in the longitudinal direction of the main drum body 34. The metal drum shaft 35 is supported in the upper frame 27, and the main drum body 34 is rotatably supported in relation to the metal drum shaft 35. With this construction, the photosensitive drum 29 is disposed in the upper frame 27 and is capable of rotating about the metal drum shaft 35.

The charger 30 is supported on the upper frame 27 diagonally above and rearward of the photosensitive drum 29. The charger 30 is disposed in opposition to the photosensitive drum 29 but separated a prescribed distance from the photosensitive drum 29 so as not to contact the same. The charger 30 includes a discharge wire 37 disposed in opposition to but separated a prescribed distance from the photosensitive drum 29, and a grid 38 provided between the discharge wire 37 and the photosensitive drum 29 for controlling the amount of corona discharge from the discharge wire 37 that reaches the photosensitive drum 29. By applying a high voltage to the discharge wire 37 for generating a corona discharge from the discharge wire 37 at the same time a bias voltage is applied to the grid 38, the charger 30 having this construction can charge the surface of the photosensitive drum 29 with a uniform positive polarity.

The developing cartridge 31 is detachably mounted on the lower frame 28 and includes an accommodating case 60 formed in a box shape that is open on the rear side. Within the developing cartridge 31 are provided a toner-accommodating chamber 39, a supply roller 40, a developing roller 41, and a thickness-regulating blade 42.

The toner-accommodating chamber 39 is formed as a space in the front side of the accommodating case 60 that is partitioned by a partitioning plate 43. The toner-accommodating chamber 39 is filled with a nonmagnetic, single-component toner T having a positive charge. The toner used in the present embodiment is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity for achieving high-quality image formation.

This type of toner is compounded with a coloring agent, such as carbon black, or wax, as well as an additive such as silica to improve fluidity. The average diameter of the toner particles is about 6-10 μm.

A rotational shaft 55 is also disposed in the center of the toner-accommodating chamber 39. An agitator 44 is supported on the rotational shaft 55 and is driven to rotate by a motive force inputted from a motor (not shown). An opening 45 connecting the toner-accommodating chamber 39 in the front of the accommodating case 60 with the rear section of the accommodating case 60 is formed below the partitioning plate 43. When driven to rotate, the agitator 44 agitates the toner T in the toner-accommodating chamber 39, causing some of the toner T to be discharged through the opening 45 toward the supply roller 40. Window members (not shown) are mounted in both the left and right walls of the accommodating case 60 in a region corresponding to the toner-accommodating chamber 39. The windows are cleaned with wipers (not shown) that are fastened on the agitator 44 and move together with the same. A light-emitting element (not shown) is provided oh the main casing 2 outside of one window member, while a light-receiving element (not shown) is provided on the main casing 2 outside of the other window member. With this construction, the light-emitting element emits a light beam, and the light-receiving element detects the light beam that passes through the accommodating case 60. In this way, it is possible to detect the existence of toner T in the accommodating case 60 based on the value outputted by the light-receiving element.

The supply roller 40 is disposed rearward of the opening 45 and is rotatably supported in the developing cartridge 31. The supply roller 40 is configured of a metal roller shaft that is covered by a roller formed of a conductive foam material. The supply roller 40 is driven to rotate by a motive force inputted from a motor (not shown).

The developing roller 41 is disposed rearward of the supply roller 40 and contacts the supply roller 40 so that both are compressed by the force. The developing roller 41 is rotatably supported in the developing cartridge 31. When the developing cartridge 31 is mounted in the lower frame 28, the developing roller 41 contacts the photosensitive drum 29. The developing roller 41 is configured of a metal roller shaft 41*a* covered by a roller that is formed of an electrically conductive rubber material. Both ends of the metal roller shaft 41*a* protrude outward from side walls of the developing cartridge 31 near the front end of the developing cartridge 31 in a widthwise direction orthogonal to the front-to-rear direction. The roller of the developing roller 41 is configured of a main roller body formed of an electrically conductive urethane rubber or silicon rubber including fine carbon particles, the surface of which body is coated with a urethane rubber or silicon rubber including fluorine. During a developing operation, a developing bias is applied to the developing roller 41. The developing roller 41 is driven to rotate in the same direction as the supply roller 40 by a motive force inputted from a motor (not shown).

The thickness-regulating blade 42 includes a main blade member 46 configured of a metal leaf spring, and a pressing part 47 provided on a free end of the main blade member 46. The pressing part 47 has a semicircular cross-section and is formed of an insulating silicon rubber. The thickness-regulating blade 42 is supported on the developing cartridge 31 above the developing roller 41. With this construction, the elastic force of the main blade member 46 causes the pressing part 47 to contact the surface of the developing roller 41 with pressure.

Toner T discharged through the opening 45 is supplied onto the developing roller 41 by the rotating supply roller 40. At this time, the toner T is positively tribocharged between the supply roller 40 and the developing roller 41. As the developing roller 41 rotates, the toner T supplied to the surface of the developing roller 41 passes between the developing roller 41 and the pressing part 47 of the thickness-regulating blade 42, thereby maintaining a uniform thickness of toner T on the surface of the developing roller 41.

The transfer roller 32 is rotatably supported on the lower frame 28 and opposes and contacts the photosensitive drum 29 in a vertical direction from the bottom of the photosensitive drum 29 when the upper frame 27 and lower frame 28 have been assembled together, so as to form a nip part with the photosensitive drum 29. The transfer roller 32 is configured of a metal roller shaft 32*a* that is covered with a roller formed of a conductive rubber material. During a transfer operation, a transfer bias is applied to the transfer roller 32. The transfer roller 32 is driven to rotate in a direction opposite the rotational direction of the photosensitive drum 29 by a motive force inputted from a motor (not shown).

The cleaning brush 33 is mounted on the lower frame 28. When the upper frame 27 and lower frame 28 are assembled, the cleaning brush 33 opposes and contacts the photosensitive drum 29 on the rear side of the photosensitive drum 29.

As the photosensitive drum 29 rotates, the charger 30 charges the surface of the photosensitive drum 29 with a uniform positive polarity. Subsequently, a laser beam emitted from the scanning unit 19 is scanned at a high speed over the surface of the photosensitive drum 29, forming an electrostatic latent image corresponding to an image to be formed on the paper 3.

Next, positively charged toner borne on the surface of the developing roller 41 comes into contact with the photosensitive drum 29 as the developing roller 41 rotates and is supplied to areas on the surface of the positively charged photosensitive drum 29 that were exposed to the laser beam and, therefore, have a lower potential. In this way, the latent image on the photosensitive drum 29 is transformed into a visible image according to a reverse developing process so that a toner image is borne on the surface of the photosensitive drum 29.

As the registration rollers 14 conveys a sheet of the paper 3 through the transfer position between the photosensitive drum 29 and transfer roller 32, the toner image borne on the surface of the photosensitive drum 29 is transferred onto the paper 3 by a transfer bias applied to the transfer roller 32. After the toner image is transferred, the paper 3 is conveyed to the fixing unit 21.

Toner remaining on the photosensitive drum 29 after the transfer operation is recovered by the developing roller 41. Further, paper dust deposited on the photosensitive drum 29 from the paper 3 is recovered by the cleaning brush 33.

(c) Fixing unit

The fixing unit 21 is disposed on the rear side of the process cartridge 20 and includes a fixed frame 48; and a heating roller 49 and a pressure roller 50 provided within the fixed frame 48.

The heating roller 49 includes a metal tube, the surface of which has been coated with a fluorine resin, and a halogen lamp disposed inside the metal tube for heating the same. The heating roller 49 is driven to rotate by a driving force inputted from a motor (not shown). The pressure roller 50 is disposed below and in opposition to the heating roller 49 and contacts the heating roller 49 with pressure. The pressure roller 50 is configured of a metal roller shaft covered with a roller that is formed of a rubber material. The pressure roller 50 follows the rotational drive of the heating roller 49.

In the fixing unit 21, toner transferred onto the paper 3 at the transfer position is fixed to the paper 3 by heat as the paper 3 passes between the heating roller 49 and pressure roller 50. After the toner is fixed to the paper 3, the heating roller 49 and pressure roller 50 continue to convey the paper 3 along a discharge path 51 that leads upward toward the top surface of the main casing 2. Discharge rollers 52 provided at the top of the discharge path 51 receive the paper 3 conveyed along the discharge path 51 and discharge the paper 3 onto a discharge tray 53 formed on the top surface of the main casing 2.

2. Configuration of the Feeding Roller and the Separating Roller

Figure 2:
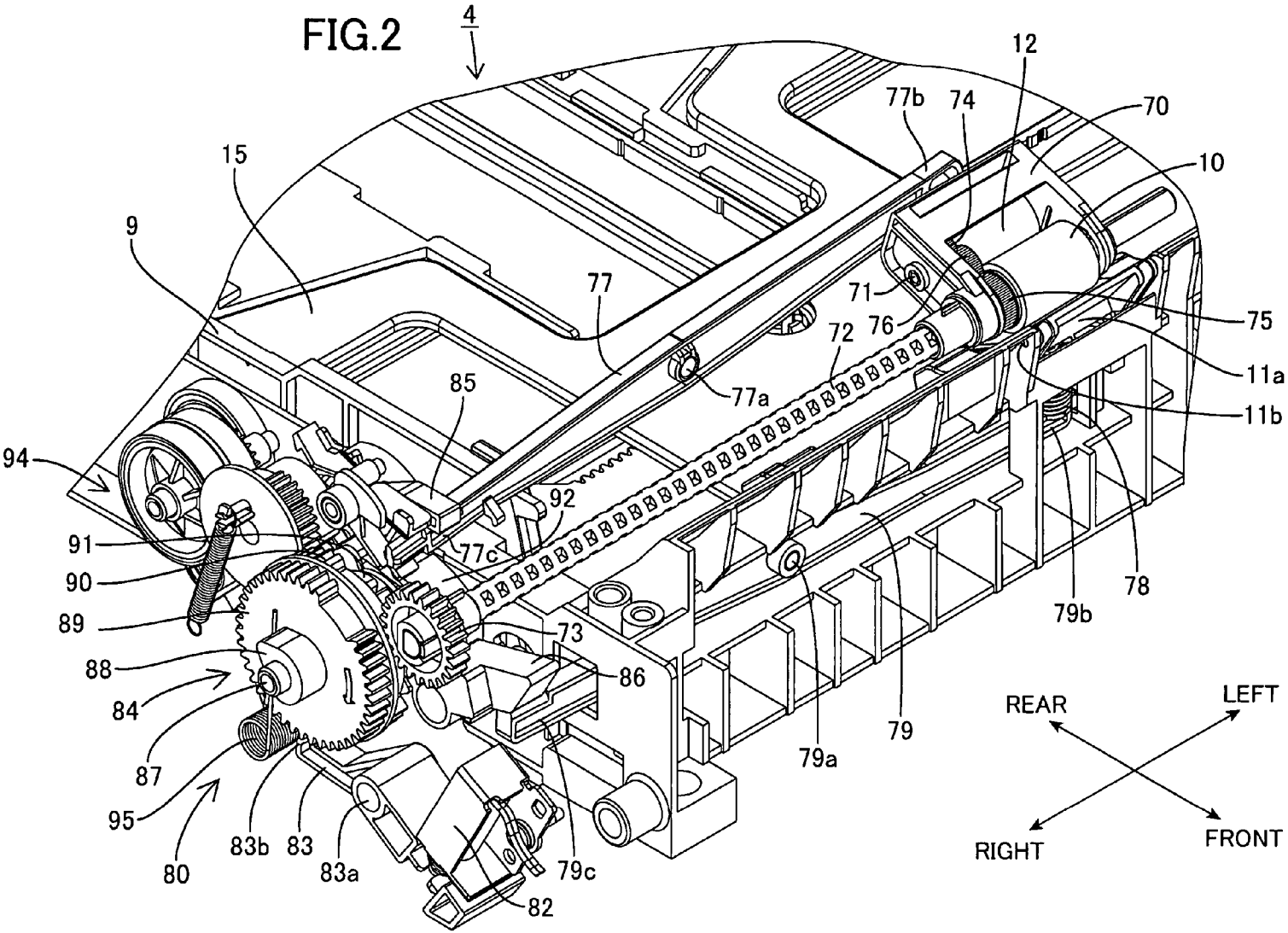
FIG. 2 is a perspective view of a gear mechanism employed in the laser printer from the front side thereof.

FIG. 2 is a perspective view from the front side of the feeding unit 4 showing a gear mechanism for transferring a driving force to the separating roller 10 and the like. In FIG. 2, the lower right area of the drawing corresponds to the front end of the laser printer 1, while the upper left area of the drawing corresponds to the rear end of the laser printer 1.

As shown in FIG. 2, the feeding roller 12 and the separating roller 10 have respective rotational shafts 71 and 72 that extend parallel to one another in a direction orthogonal to the conveying direction. The feeding roller 12 and the separating roller 10 are rotatably supported in a bearing member 70 via the rotational shafts 71 and 72. One end of the rotational shaft 72 penetrates a side wall of the bearing member 70 and extends toward a gear mechanism 80 described later. A separating roller gear 73 is integrally provided on this extended end of the rotational shaft 72. Upon receiving a driving force from the gear mechanism 80, the separating roller gear 73 rotates the rotational shaft 72 and, consequently, the separating roller 10 that rotates together with the rotational shaft 72.

The bearing member 70 is configured so that the feeding roller 12 side pivots about the rotational shaft 72 (indicated by the arrow depicted in outline in FIG. 1). The paper-pressing plate 15 is raised by the rotation of the lever shaft 18. As a result, the feeding roller 12 pivots upward when the topmost sheet of the paper 3 stacked in the paper-pressing plate 15 contacts the feeding roller 12 from below.

Gears 74 and 75 are provided coaxially with the feeding roller 12 and separating roller 10 so as to rotate together with the rotational shafts 71 and 72, respectively. The separating roller 10 and feeding roller 12 are configured to rotate in association with each other, owing to a linkage gear 76 that is engaged with the gears 74 and 75. Hence, when the separating roller 10 is driven to rotate, the feeding roller 12 rotates along with the separating roller 10.

3. Shifting Mechanism for the Feeding Roller

As shown in FIG. 2, an arm 77 is provided on the rear side of the rotational shaft 72. The arm 77 is swingably supported at an approximate center position 77*a* so as to be parallel to the rotational shaft 72. One end 77*b* of the arm 77 is connected with the pivoting end of the bearing member 70 near the feeding roller 12, while another end 77*c* is engaged with the gear mechanism 80.

Figure 3:
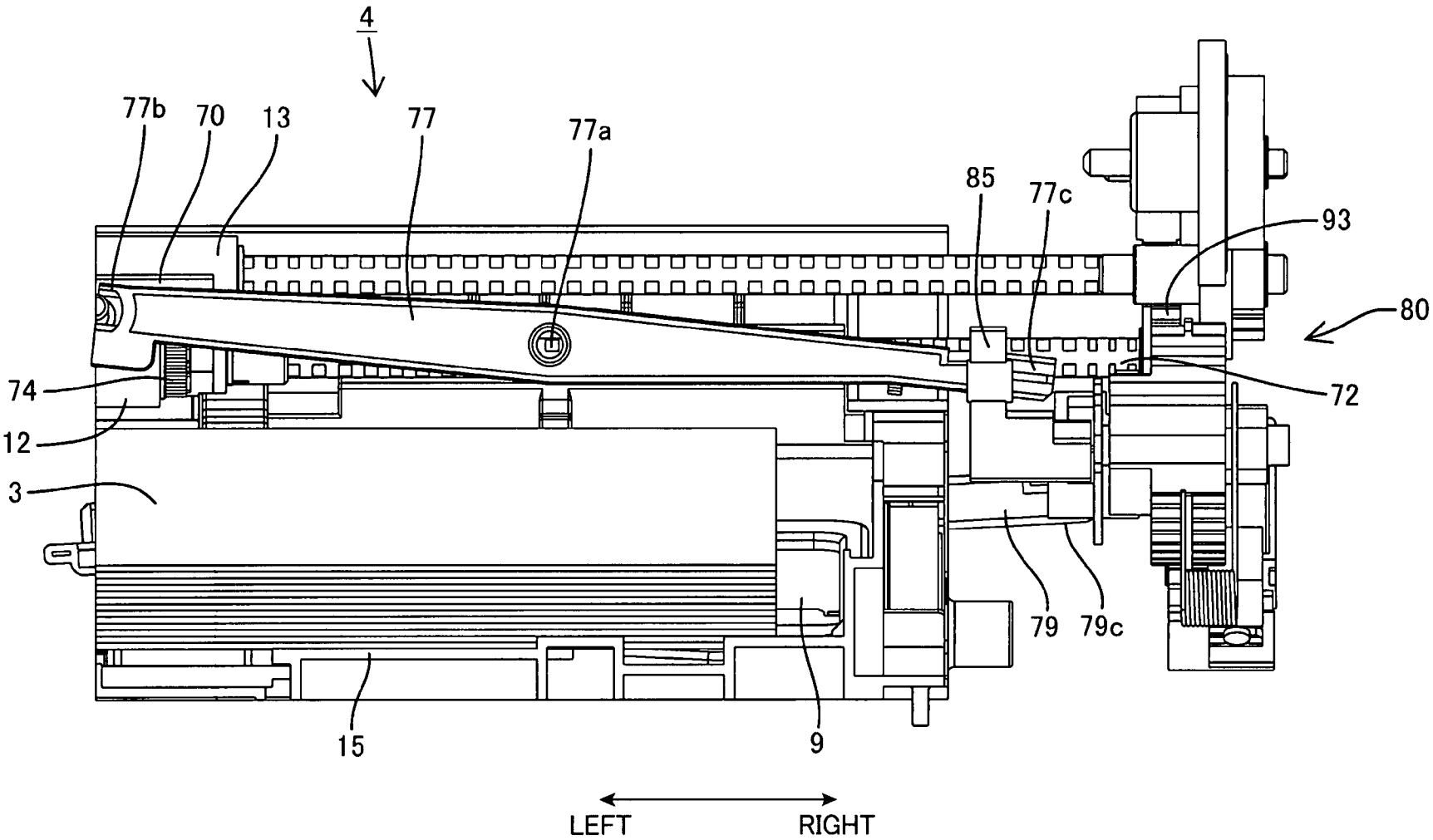
FIG. 3 is a rear view of a feeding unit of the laser printer when a feeding roller is in a separated position.
Figure 4:
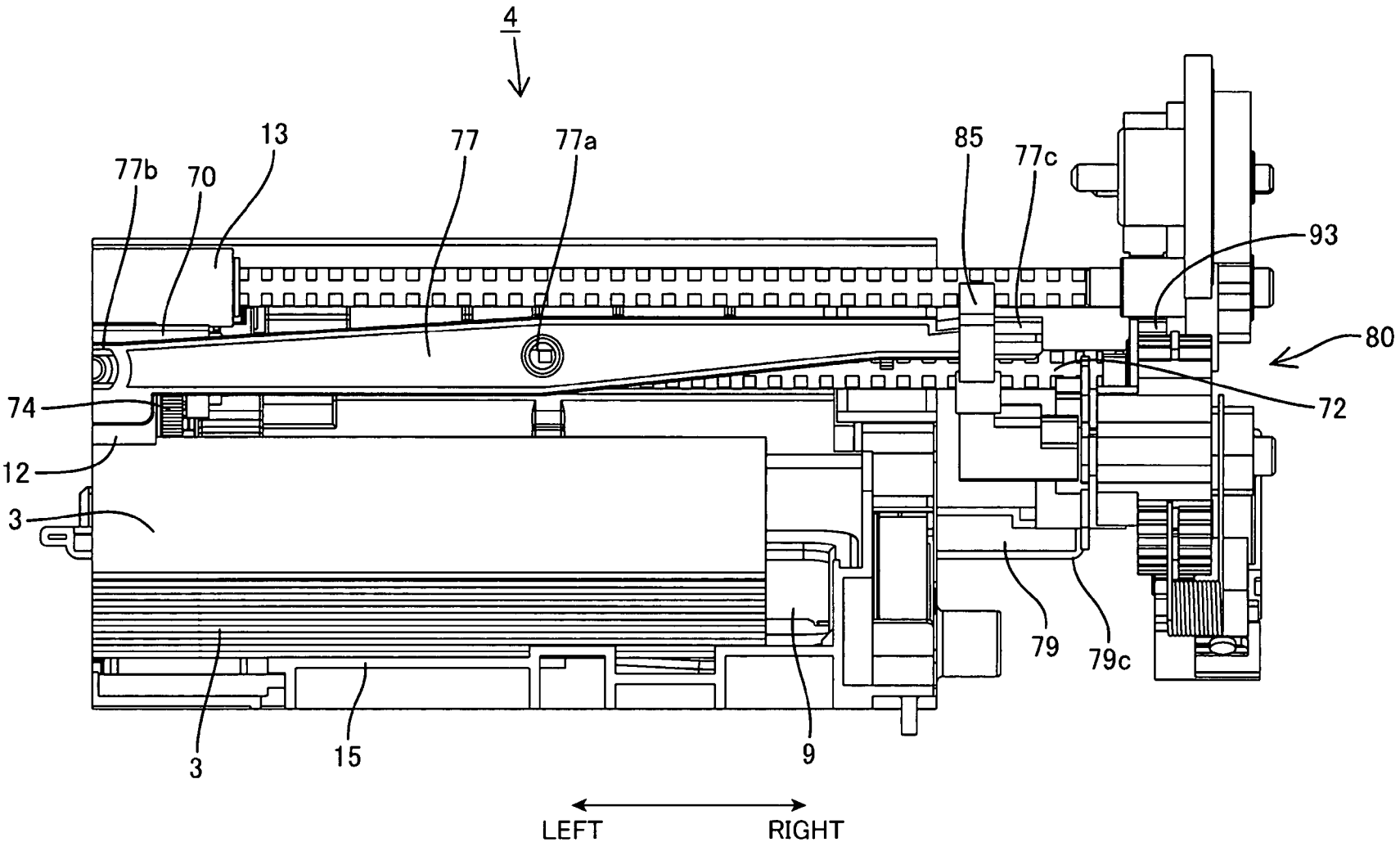
FIG. 4 is a rear view of the feeding unit when the feeding roller is in a contact position.

FIG. 3 is a rear view of the feeding unit 4 when the feeding roller 12 is in a separated position, and FIG. 4 is a rear view of the feeding unit 4 when the feeding roller 12 is in a contact position. In both drawings, the rear end of the laser printer 1 is in the foreground and the front end in the background.

With this construction, as shown in FIG. 3, the gear mechanism 80 pushes the end 77*c* of the arm 77 downward, causing the feeding roller 12 to move upward and separate from the paper stacked on the paper-pressing plate 15. Hereinafter, this position of the feeding roller 12 will be referred to as the "separated position." However, as shown in FIG. 4, when the force of the gear mechanism 80 pushing down on the end 77*c* is released, the feeding roller 12 drops downward by its own weight and contacts the paper stacked on the paper-pressing plate 15. Hereinafter, this position of the feeding roller 12 will be referred to as the "contact position."

4. Pressure Changing Mechanism between the Separating Pad and the Separating Roller As shown in FIG. 1, the separating pad 11 is spread over a rectangular plate 11*a*. The front end of the rectangular plate 11*a* is pivotally supported by a support shaft 11*b* so that the rear end of the rectangular plate 11*a* can pivot. A spring 78 such as a coil spring is disposed on the underside of the rectangular plate 11*a* for pressing the rectangular plate 11*a* upward. Consequently, the urging force of the spring 78 presses the separating pad 11 against the separating roller 10.

As shown in FIG. 2, an arm 79 is provided beneath the rotational shaft 72. The arm 79 is swingably supported at an approximate center position 79*a* so as to be parallel to the rotational shaft 72. One end 79*b* of the arm 79 contacts the bottom edge of the spring 78, while another end 79*c* of the arm 79 is engaged with the gear mechanism 80.

Figure 5:
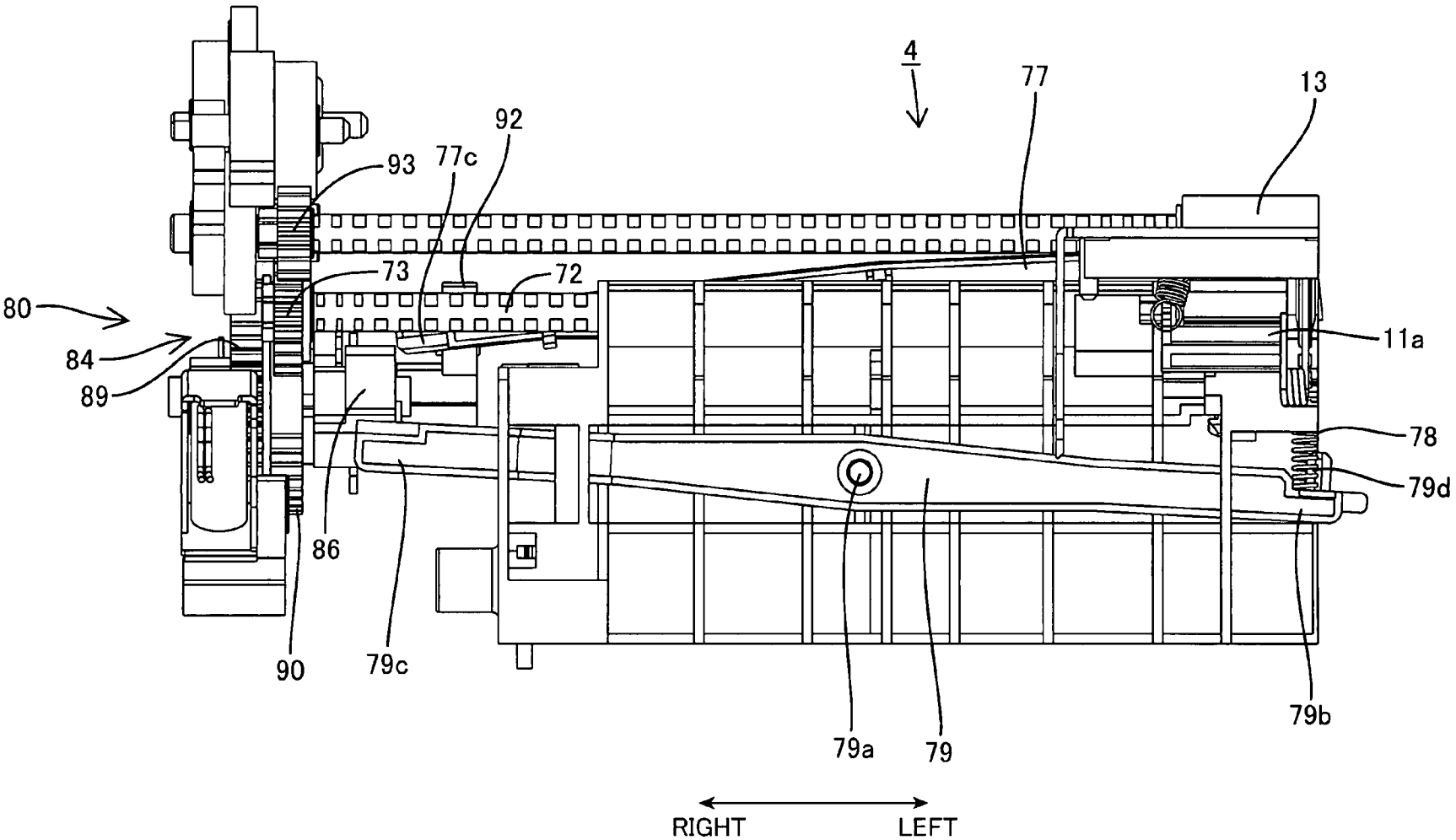
FIG. 5 is a front view of the feeding unit when a separating roller and a separating pad are in a low-pressure state.
Figure 6:
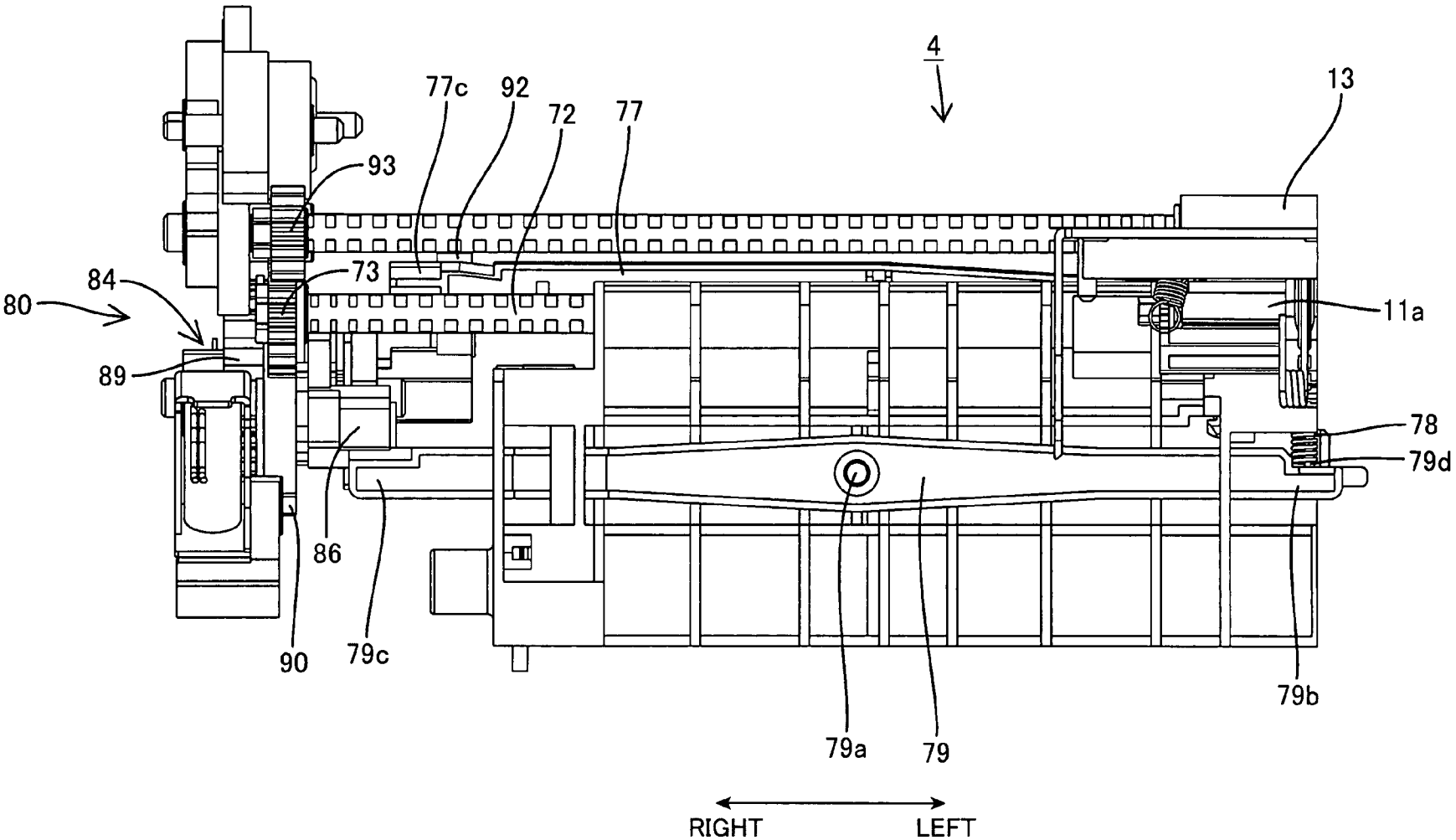
FIG. 6 is a front view of the feeding unit when the separating roller and the separating pad are in a high-pressure state.

FIG. 5 is a front view of the feeding unit 4 when the pressure between the separating pad and separating roller is small, and FIG. 6 is a front view of the feeding unit 4 when the pressure between the separating pad and separating roller is large. In both drawings, the front end of the laser printer 1 is in the foreground and the rear end is in the background.

With this construction, as shown in FIG. 5, when the end 79*c* of the arm 79 is in an upward position, the end 79*b* of the arm 79 is positioned downward so that the spring 78 is compressed by an amount related to the distance of separation between the end 79*b* and the underside surface of the rectangular plate 11*a*. Hereinafter, this state will be referred to as a "low-pressure state." However, as shown in FIG. 6, when the end 79*c* of the arm 79 is moved downward, the end 79*b* moves upward and pushes the bottom end of the spring 78, compressing the spring 78 and thereby increasing the force with which the separating pad 11 pushes against the separating roller 10. Hereinafter, this state will be referred to as a "high-pressure state."

As shown in FIGS. 5 and 6, the end 79*b* of the arm 79 has a protruding part 79*d* that protrudes upward. The protruding part 79*d* is inserted into the spring 78 from below so as to fix the position of the spring 78 with respect to the end 79*b*.

5. Gear Mechanism

Next, the gear mechanism 80 will be described. The gear mechanism 80 includes a plurality of gears that are driven to rotate by a driving force received from a drive motor 100 provided on the main casing 2. The gear mechanism 80 primarily controls the following operations.

(a) An operation to rotate the rotational shaft 72 and, consequently, the separating roller 10 (hereinafter referred to as a "roller driving operation"; here, the "roller driving operation" means operations to toggle on and off transfer of the driving force that rotates the separating roller 10)

(b) An operation to move the end 77*c* of the arm 77 up and down and, consequently, raise and lower the feeding roller 12 (hereinafter referred to as a "feeding roller raising/lowering operation")

(c) An operation to move the end 79*c* of the arm 79 up and down and, consequently, adjust the pressure between the separating roller 10 and separating pad 11 (hereinafter referred to as a "pressure increasing/reducing operation")

More specifically, as shown in FIG. 2, the gear mechanism 80 includes the separating roller gear 73 described above, an input gear 81 (see FIG. 7), a solenoid switch 82, a solenoid lever 83, a sector gear 84, a lift lever 85, a separating lever 86, and the like.

(1) Solenoid Switch and Solenoid Lever

Figure 7:
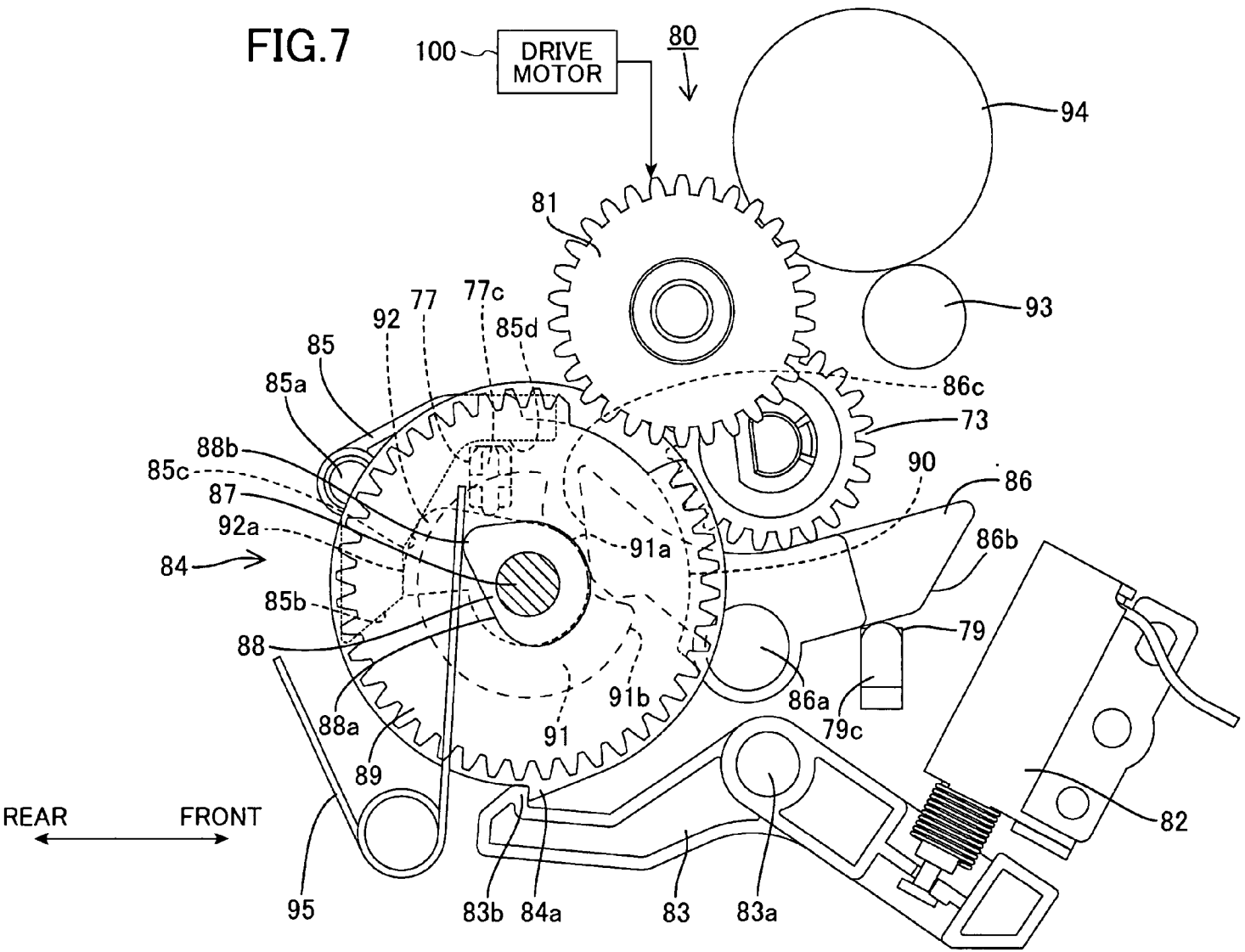
FIG. 7 is a first explanatory diagram showing the structure of the gear mechanism.
Figure 8:
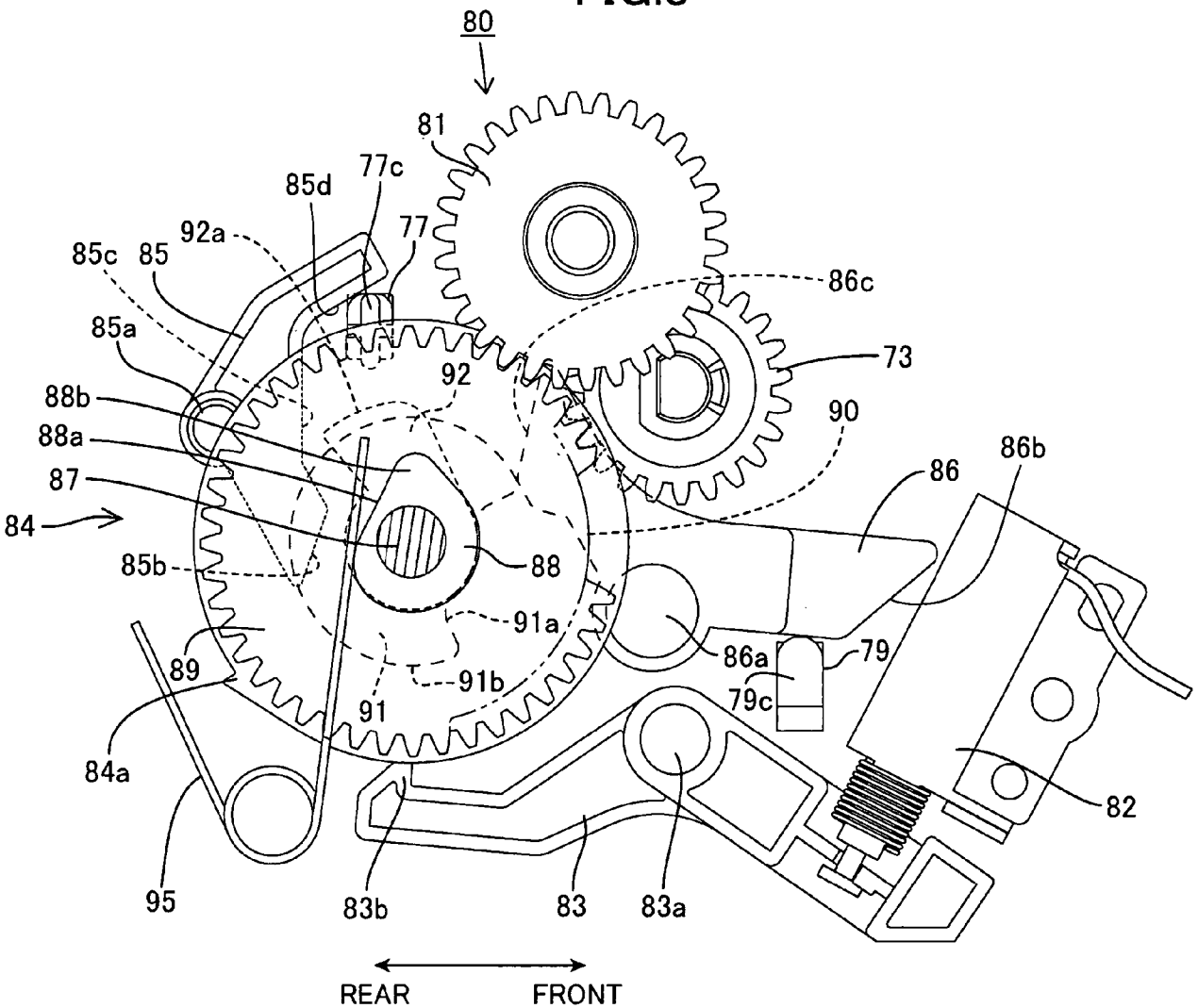
FIG. 8 is a second explanatory diagram showing the structure of the gear mechanism.
Figure 9:
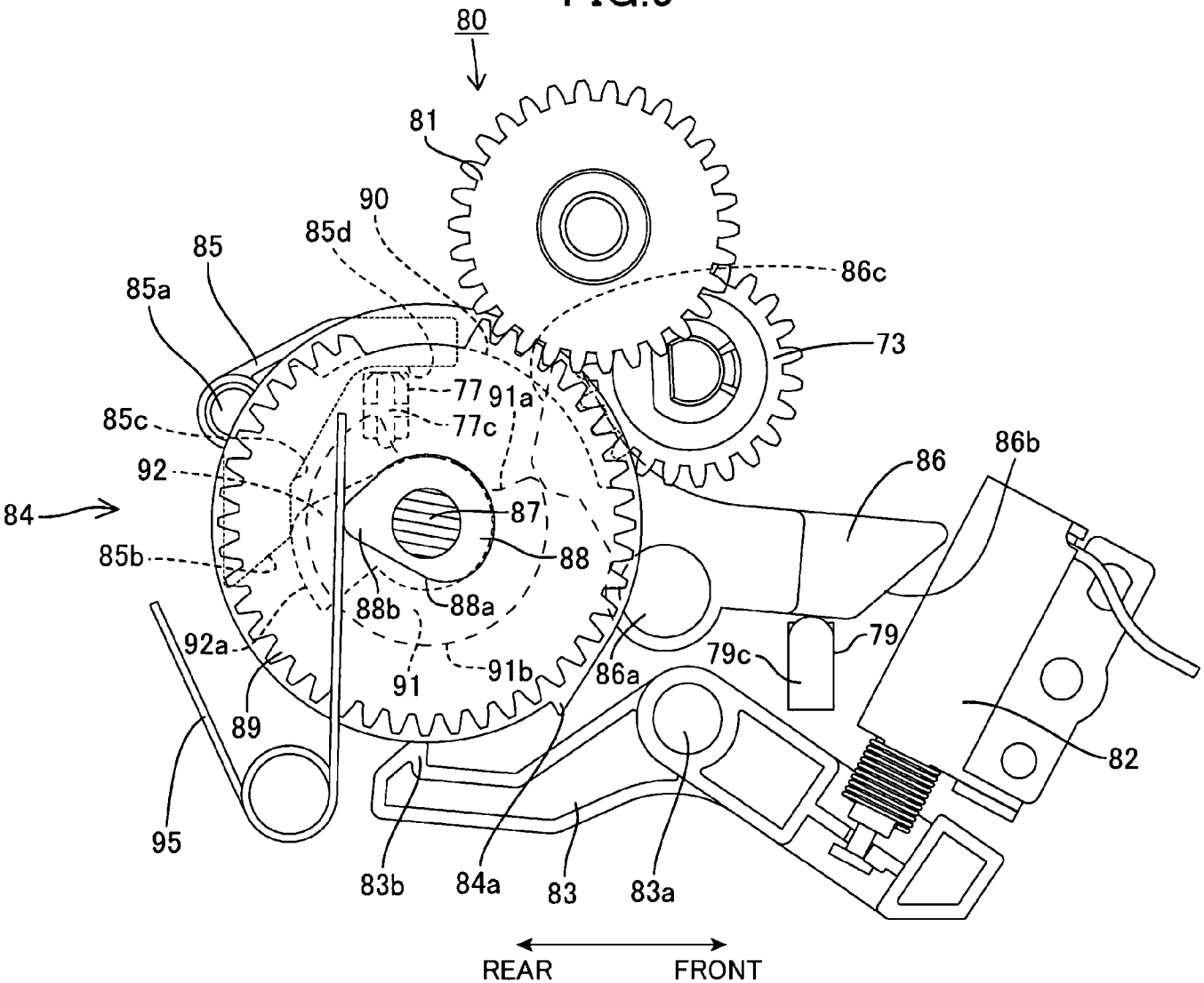
FIG. 9 is a third explanatory diagram showing the structure of the gear mechanism.

FIGS. 7 through 9 are explanatory diagrams showing simplified structures of the gear mechanism 80. In each of these drawings, the front end of the laser printer 1 is on the right side and the rear end on the left.

As shown in FIG. 7, the solenoid switch 82 functions as a switch that turns on each time a start signal for an image forming operation is received. The solenoid lever 83 is swingably supported at an approximate center position 83*a* thereof. When the solenoid switch 82 turns on, the front end of the solenoid lever 83 raises upward. An engaging pawl 83*b* is integrally formed on the rear end of the solenoid lever 83. An engaging protrusion 84*a* protrudes from the peripheral surface of the sector gear 84 for engaging with the engaging pawl 83*b*.

(2) Sector gear

The sector gear 84 is supported on a rotational shaft 87. In addition to the engaging protrusion 84*a* described above, the sector gear 84 includes a first cam 88 that rotates together with the rotational shaft 87, a first partially-toothed gear 89, a second partially-toothed gear 90, a second cam 91, and a third cam 92.

(a) First partially-toothed gear

More specifically, as shown in FIG. 7, the first partially-toothed gear 89 has a section missing consecutive gear teeth. The first partially-toothed gear 89 is driven to rotate when the first partially-toothed gear 89 is engaged with the input gear 81 and a driving force is inputted into the input gear 81 from the drive motor 100. However, when the engaging pawl 83*b* of the solenoid lever 83 is engaged with the engaging protrusion 84*a* of the sector gear 84, the toothless section of the first partially-toothed gear 89 faces the input gear 81. Hence, at this time, the driving force from the input gear 81 is not transferred to the sector gear 84.

(b) First Cam

The first cam 88 is disposed on the right side of the first partially-toothed gear 89 (down and to the left in FIG. 2 and in the foreground of FIG. 7). The first cam 88 has a flat part 88*a* in a plane parallel to the rotational shaft 87 so that a cross-section of the first cam 88 orthogonal to the rotational shaft 87 is shaped substantially like the letter D. When viewing the cross-section of the first cam 88, one end of the flat part 88*a* protrudes to form a large diameter part 88*b*. A sector spring 95 is disposed near the first cam 88 and contacts the large diameter part 88*b* with pressure when the first cam 88 is positioned as shown in FIG. 7. When the solenoid switch 82 is operated, releasing the engagement of the solenoid lever 83, the sector spring 95 forcibly pushes the first cam 88 clockwise in FIG. 7, causing the sector gear 84 to rotate to a position in which the first partially-toothed gear 89 is engaged with the input gear 81.

(c) Second Partially-Toothed Gear

The second partially-toothed gear 90 is disposed on the left side of the first partially-toothed gear 89 (upward to the right in FIG. 2 and in the background of FIG. 7). The second partially-toothed gear 90 has a continuous portion without gear teeth equivalent to approximately one-third of the entire circumference. The second partially-toothed gear 90 functions to engage with the separating roller gear 73 in order to drive the separating roller 10 to rotate. Since the second partially-toothed gear 90 is not engaged with the separating roller gear 73 in FIG. 7, the separating roller 10 can rotate idly. Hence, the roller driving operation described above can be executed (in this case, the "roller driving operation" means an operation to stop transfer of the driving force that rotates the separating roller 10).

(d) Second Cam

The second cam 91 is disposed on the left side of the second partially-toothed gear 90. The second cam 91 has a continuous small diameter part 91*a* equivalent to approximately one-fourth of its entire circumference and a large diameter part 91*b* accounting for the remainder of the circumference. The separating lever 86 is swingably supported about its approximate center position 86*a* near the second cam 91. A front end 86*b* of the separating lever 86 contacts the end 79*c* of the arm 79 from above to modify the urging force provided by the spring 78. A rear end 86*c* of the separating lever 86 contacts the peripheral surface of the second cam 91. With this construction, when the second cam 91 rotates so that the rear end 86*c* of the separating lever 86 is lifted up from the small diameter part 91*a* to the large diameter part 91*b* of the second cam 91, the separating lever 86 is inclined so that the front end 86*b* pivots downward, compressing the spring 78 and increasing the pressure between the separating roller 10 and separating pad 11. In this way, the pressure increasing/reducing operation described above can be implemented.

(e) Third Cam

The third cam 92 is disposed on the left side of the second cam 91. The third cam 92 protrudes substantially unidirectionally from the rotational shaft 87. The lift lever 85 is shaped substantially like the letter L and is swingably supported about a center position 85*a* near the third cam 92. The third cam 92 has a protruding end 92*a*. When the protruding end 92*a* contacts a rear inside surface 85*c* of the lift lever 85, a front inside surface 85*d* of the lift lever 85 contacts the top of the end 77*c* of the arm 77 and pushes the end 77*c* downward in order to raise the feeding roller 12. Hence, the feeding roller 12 is placed in the separated position at this time. However, as shown in FIG. 8, when the third cam 92 rotates so that the protruding end 92*a* separates from the rear inside surface 85*c* of the lift lever 85, thereby disengaging from the lift lever 85, the feeding roller 12 moves to the contact position due to its own weight. In this way, the feeding roller raising/lowering operation described above can be implemented.

As shown in FIG. 7, a drive gear 93 is linked to the input gear 81 via a speed changing gear 94 for driving the opposing roller 13 to rotate. While not described in detail herein, a plurality of the speed changing gears 94 are provided as shown in FIG. 2 for receiving the driving force from the input gear 81 and pivotally moving the lever 17. The speed changing gears 94 are controlled to turn the pivotal movement of the lever 17 on and off in order to raise the paper-pressing plate 15 to the supplying position.

6. Operations

FIGS. 10 through 13 are left side views of the feeding unit 4, wherein the front end of the laser printer 1 is on the left side of the drawings and the rear end on the right.

(1) Home Position

Figure 10:
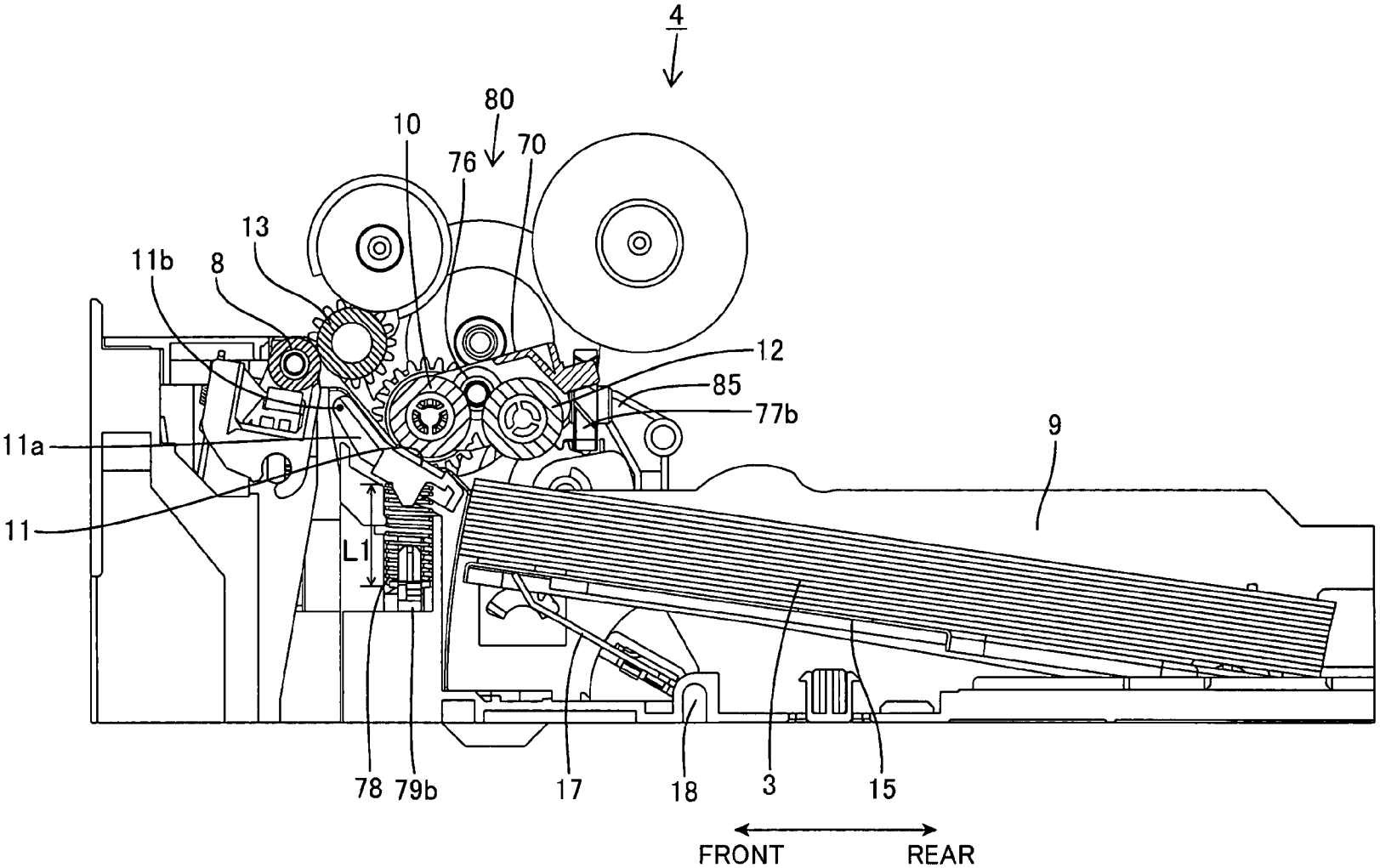
FIG. 10 is a left side cross-sectional view of the feeding unit in a home position.
Figure 11:
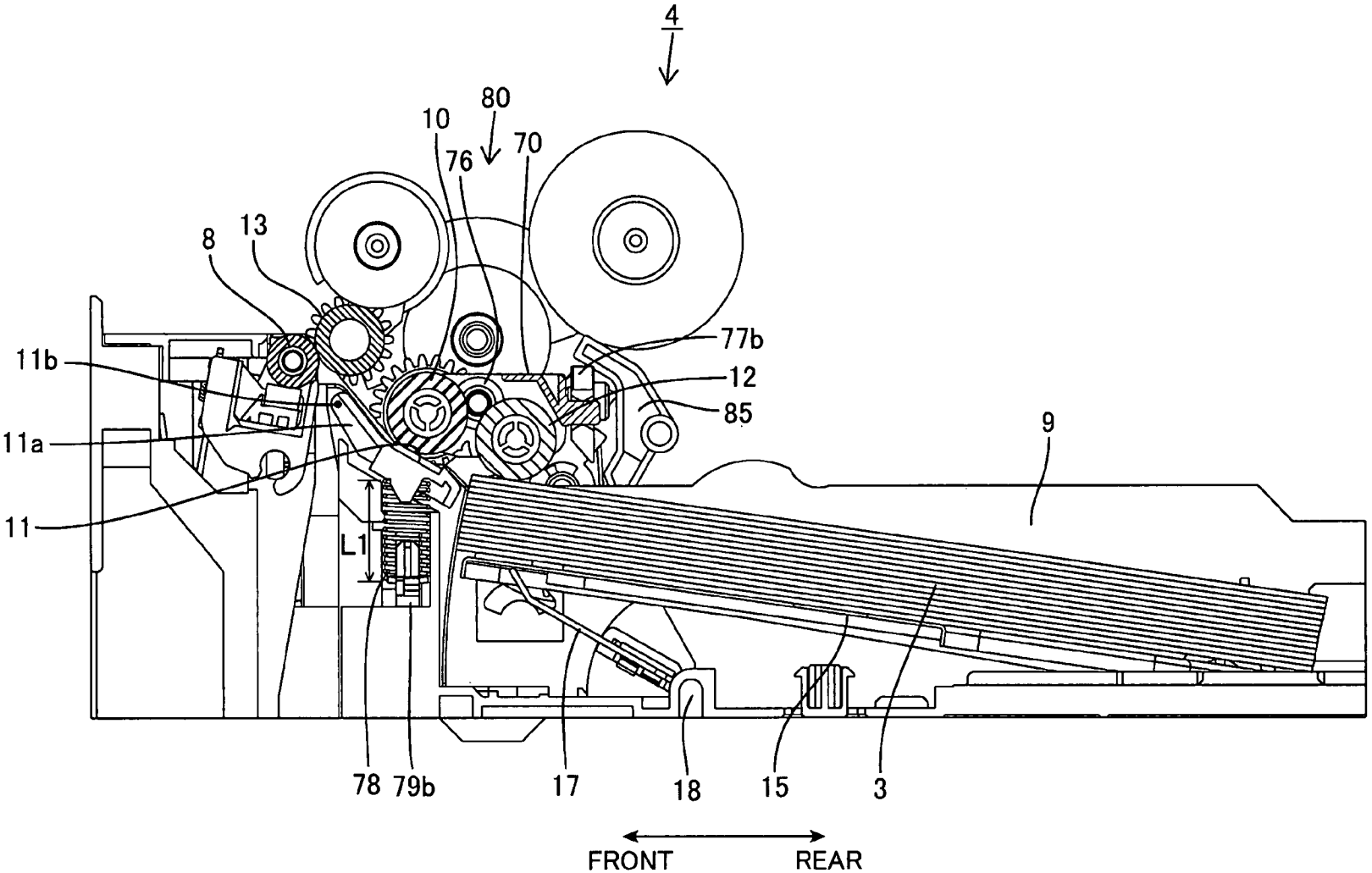
FIG. 11 is a left side cross-sectional view of the feeding unit after the feeding roller is moved down.

When the power to the laser printer 1 is turned on, the drive motor 100 generates a driving force that is transferred to the input gear 81. The input gear 81 in turn drives the opposing roller 13 to rotate via the speed changing gear 94 and drive gear 93. Further, the paper-pressing plate 15 is raised to the supplying position shown in FIG. 10. At this time, the gear mechanism 80 is in the state shown in FIG. 7. In other words, the sector gear 84 is engaged with the solenoid lever 83 so that a driving force is not transferred from the input gear 81 to the sector gear 84. Further, the protruding end 92*a* of the third cam 92 contacts the lift lever 85 so that the lift lever 85 is pushing down on the end 77*c* of the arm 77. Hence, as shown in FIG. 10 (and FIG. 3), the feeding roller 12 is in the separated position, separated from the paper 3 stacked on the paper-pressing plate 15.

Further, as shown in FIG. 7, the separating lever 86 is in contact with the small diameter part 91*a* of the second cam 91, allowing the end 79*c* of the arm 79 to move upward. In other words, the end 79*b* of the arm 79 is inclined downward so that the spring 78 is in the low compression state shown in FIG. 5. That is, the spring 78 is compressed to a length corresponding to the distance between the end 79*b* and the rectangular plate 11*a* (a length L1 shown in FIG. 10).

(2) Start of the Feeding Operation (Conveying Operation)

At the beginning of an image forming operation, a start signal for starting the image forming operation on the first sheet of paper 3 is transmitted to the solenoid switch 82, turning the solenoid switch 82 on. As a result, as shown in FIG. 8, the solenoid lever 83 is disengaged from the sector gear 84, allowing the urging force of the sector spring 95 to rotate the sector gear 84 to a position in which the first partially-toothed gear 89 becomes engaged with the input gear 81. As a result, the driving force is transferred from the input gear 81 to the sector gear 84 and the sector gear 84 begins to rotate.

At the same time, the third cam 92 rotates and disengages from the lift lever 85, allowing the end 77*c* of the arm 77 to move upward. As a result, the feeding roller 12 drops down to the contact position shown in FIG. 4 and FIG. 11. In the contact position, the feeding roller 12 contacts the paper stacked on the paper-pressing plate 15.

Figure 12:
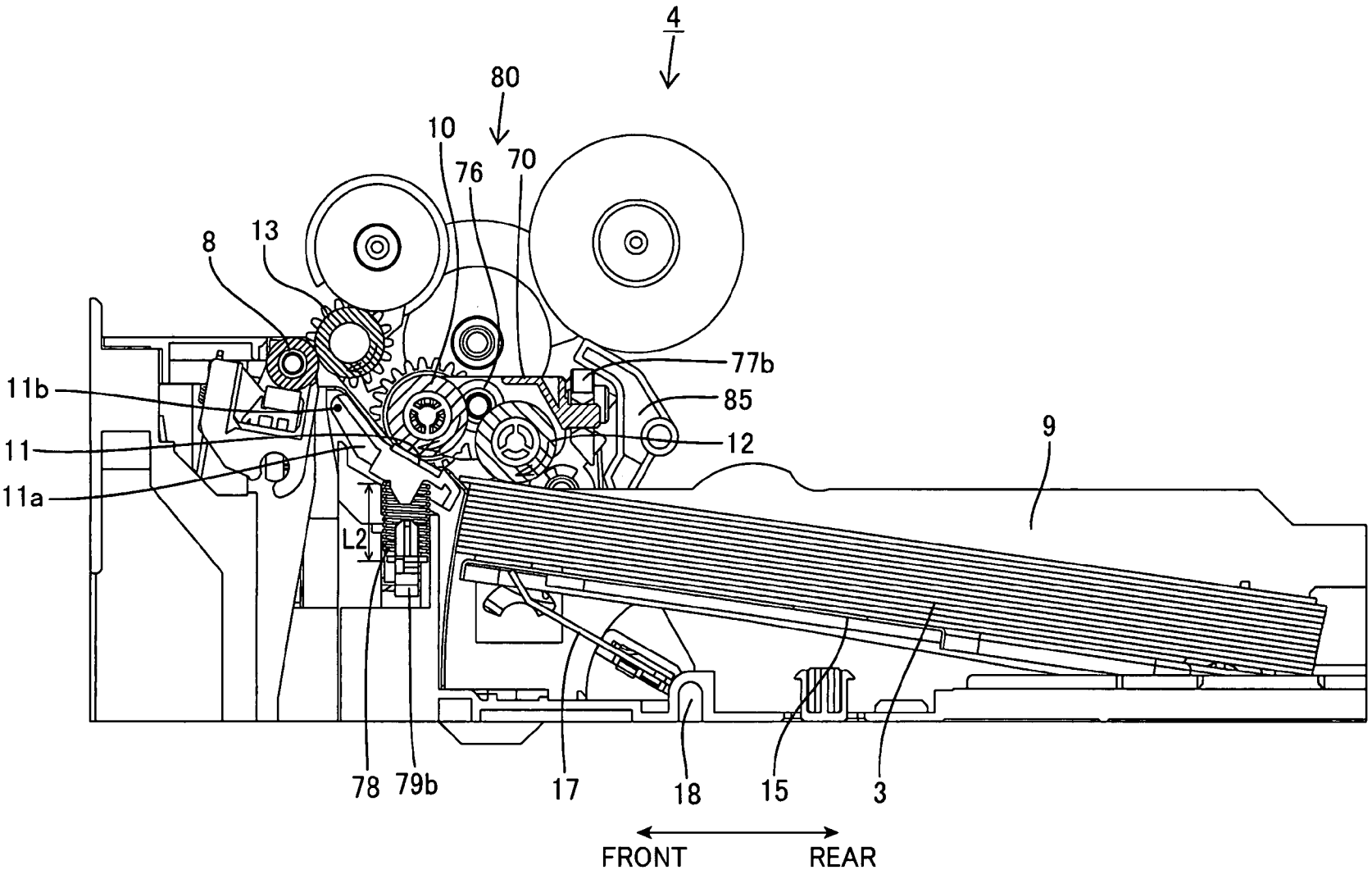
FIG. 12 is a left side cross-sectional view of the feeding unit when the separating roller and the separating pad are in a high-pressure state.

Further, when the second cam 91 rotates, the rear end of the separating lever 86 slides up onto the large diameter part 91*b* of the second cam 91, causing the front end of the separating lever 86 to push down on the end 79*c* of the arm 79. Accordingly, the end 79*b* of the arm 79 is inclined upward as shown in FIG. 6 so that the spring 78 is further compressed as shown in FIG. 12. At this time, the spring 78 is compressed to a length L2 (less than L1) shown in FIG. 12, generating the high-pressure state between the separating pad 11 and separating roller 10.

Subsequently, as shown in FIG. 8, the second partially-toothed gear 90 becomes engaged with the separating roller gear 73, so that the driving force is transferred from the input gear 81 to the separating roller 10 to begin rotating the separating roller 10. The feeding roller 12 is also driven to rotate along with the separating roller 10 and, hence, the feeding roller 12 begins an operation to feed a sheet of the paper 3.

Through the process described above, the feeding roller 12 contacts the paper 3 stacked on the paper-pressing plate 15 and conveys the paper 3 downstream in the conveying direction. The topmost sheet of the paper 3 is reliably separated from the other sheets at the nip position between the separating pad 11 and separating roller 10, which are pressed together with a relatively strong urging force corresponding to the length L2 described above.

(3) Raising the Feeding Roller and Reducing Pressure of the Separating Pad

Figure 13:
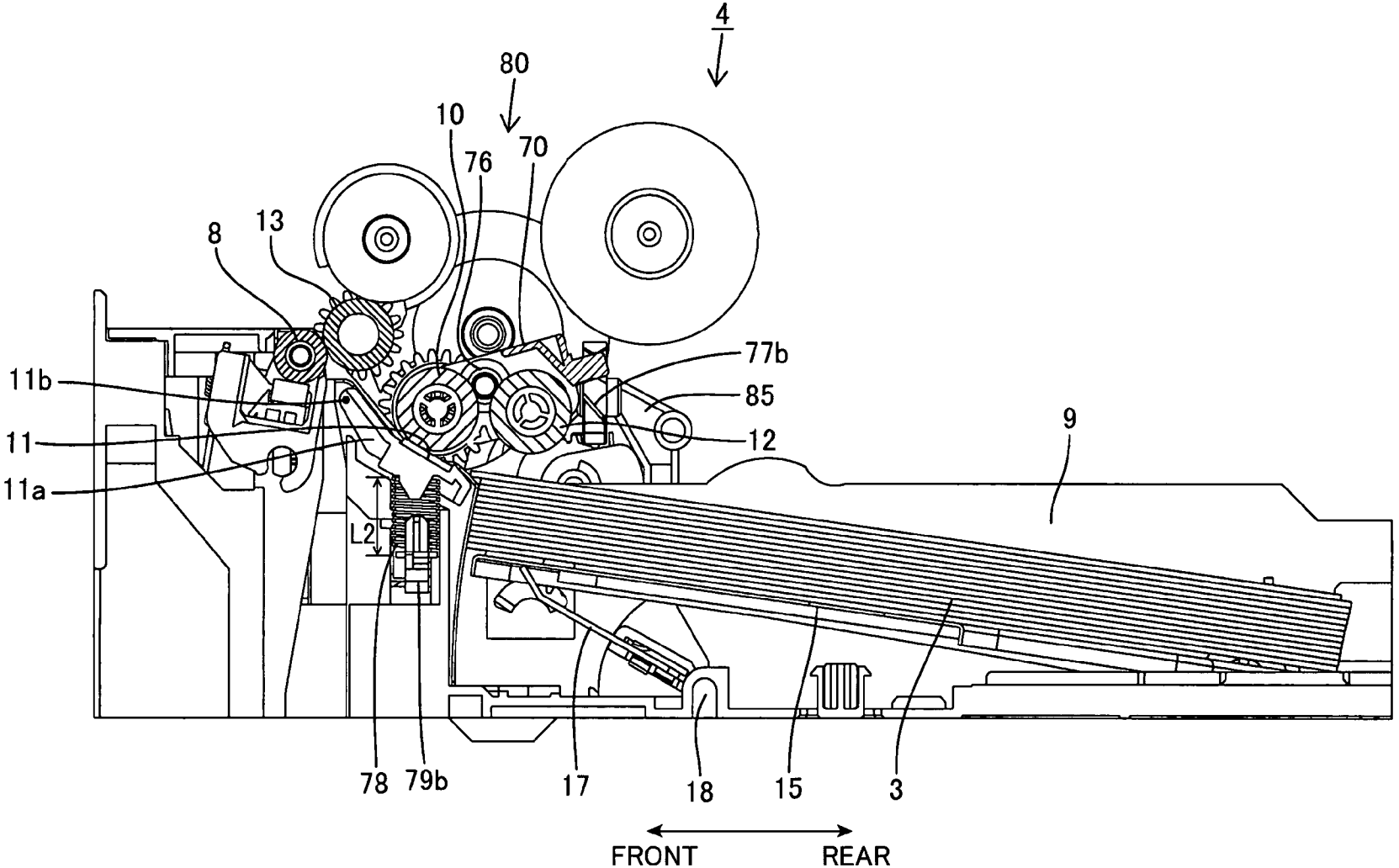
FIG. 13 is a left side cross-sectional view of the feeding unit after the feeding roller is moved up.

When the leading edge of the sheet of paper 3 separated by the separating pad 11 and separating roller 10 reaches a nip position between the paper dust roller 8 and opposing roller 13 (conveying position; or the nip position between the registration rollers 14), as shown in FIG. 9, the protruding end 92*a* of the third cam 92 comes into contact with a tapered surface 85*b* formed on the lift lever 85. The protruding end 92*a* is gradually guided along the tapered surface 85*b*, moving the lift lever 85 to a position in which the front end of the lift lever 85 is pressing down on the end 77*c* of the arm 77. As a result, as shown in FIG. 13, the feeding roller 12 is moved to the separated position (feeding roller raising operation), separated from the paper 3 stacked on the paper-pressing plate 15.

Subsequently, the rear end of the separating lever 86 slides from the large diameter part 91*b* of the second cam 91 to the small diameter part 91*a*, allowing the end 79*c* of the arm 79 to move upward. Hence, the spring 78 returns to the length L1, returning the separating pad 11 and separating roller 10 to the low-pressure state in which the force urging the separating pad 11 against the separating roller 10 is less than that at the beginning of the feeding operation described above (pressure reducing operation). At this time, the separated topmost sheet is still nipped between the separating pad 11 and the separating roller 10.

Since the feeding roller 12 has already been moved to the separated position and does not contact the paper 3, the feeding roller 12 does not offer any resistance to the sheet of paper 3 being conveyed. Hence, the separating pad 11 and separating roller 10 can demonstrate a sufficient separating capacity even when the pressure between the separating pad 11 and separating roller 10 is reduced. By eliminating resistance from the feeding roller 12 to the conveyed sheet of paper 3 and reducing the, conveying resistance by the separating pad 11 and separating roller 10, the paper dust roller 8 and opposing roller 13 and the registration rollers 14 can convey the sheet of paper 3 smoothly.

Subsequently, when the toothless section of the first partially-toothed gear 89 rotates opposite the input gear 81, the sector gear 84 once again engages with the solenoid lever 83 and is thus returned to the home position. In this state, the separating roller 10 rotates idly (roller driving operation).

Thereafter, the gear mechanism 80 repeatedly executes the series of operations described above each time a start signal is transmitted to the solenoid switch 82 for initiating an image forming operation on subsequent sheets of the paper 3.

7. Effects (1) In the above-described embodiment, after a feeding operation is initiated to feed a sheet of the paper 3, the feeding roller 12 is separated from the paper 3, and the separating pad 11 and separating roller 10 are shifted from the high-pressure state to the low-pressure state. In this way, the feeding roller 12 does not provide resistance to the conveyed sheet and the resistance applied to the sheet from the separating pad 11 and separating roller 10 is reduced, enabling the sheet of paper 3 to be conveyed smoothly from this point. Since the separating pad 11 and separating roller 10 demonstrate a reliable separating capacity at this time, subsequent sheets of the paper 3 that may be attracted to the topmost sheet by static electricity or the like can be reliably separated. Further, paper dust and frictional noise produced during the conveying process can be suppressed by reducing the resistance to the conveyed sheet (back tension).

(2) By providing the feeding roller 12 and the separating roller 10 as separate rollers, the roller diameter can be made smaller than when a single common roller is provided for both functions, thereby enabling the production of a more compact device.

(3) If transfer of the driving force for driving the separating roller 10 to rotate is halted before the gear mechanism 80 begins the pressure reducing operation, resistance to the sheet being conveyed rises temporarily at the time the transfer is halted. Therefore, in the above-described embodiment, transfer of the driving force is halted after the pressure reducing operation has begun.

(4) When the leading edge of the paper 3 reaches the nip position between the paper dust roller 8 and the opposing roller 13 or the nip position between the registration rollers 14 (conveying position) at which position the paper 3 can be conveyed by these rollers, the feeding unit 4 executes the feeding roller raising operation to move the feeding roller 12 to the separated position and executes the pressure reducing operation. As a result, the paper dust roller 8 and opposing roller 13 and the registration rollers 14 can smoothly convey the sheet of paper 3.

(5) If the pressure reducing operation is executed prior to the feeding roller raising operation for moving the feeding roller 12 to the separated position, the separating pad 11 and separating roller 10 may not be able to reliably separate the topmost sheet of paper from subsequent sheets due to the strong conveying force of the feeding roller 12. Therefore, the feeding unit 4 of the above-described embodiment is configured to execute the pressure reducing operation after the feeding roller raising operation.

(6) The feeding unit 4 of the above-described embodiment is also configured to perform the feeding roller raising operation and the pressure reducing operation with the gear mechanism 80. This construction prevents incorrect operations that may occur through software control. Moreover, the gear mechanism 80 that performs this control is rotated by the driving force from the common drive motor 100. In other words, control is implemented by the first partially-toothed gear 89, second partially-toothed gear 90, second cam 91, and third cam 92 that rotate together with the same rotational shaft 87. Hence, the timings at which the pressure reducing operation, feeding roller raising operation, and roller driving operation are performed can be adjusted with relative ease by modifying the relative positions of the first partially-toothed gear 89, second partially-toothed gear 90, second cam 91, and third cam 92 in the circumferential direction with respect to the rotational shaft 87.

While the invention has been described in detail with reference to the specific embodiment thereof, it would be apparent to those skilled in the art that various changes and modifications may be made therein without departing from the spirit of the invention.

(1) In the above-described embodiment, control of the pressure reducing operation, feeding roller raising operation, and roller driving operation is implemented through mechanical control with the gear mechanism 80. However, these operations may also be controlled through software. However, the above-described effect (6) can only be obtained through the mechanical control.

(2) In the above-described embodiment, while the feeding roller 12 is raised and lowered to shift between a separated position and a contact position, this shifting may be achieved by raising and lowering the paper-pressing plate 15 through pivotal movement of the lever 17.

(3) In the above-described embodiment, the feeding roller 12 is separated from the paper 3 stacked on the paper-pressing plate 15 so that the feeding roller 12 applies no contact force to the paper 3. However, the feeding unit 4 may be configured to reduce the force with which the feeding roller 12 contacts the paper 3 after initiating the feeding operation, while maintaining the feeding roller 12 in contact with the paper 3.

(4) In the above-described embodiment, the feeding unit 4 reduces the force with which the spring 78 presses the separating pad 11 against the separating roller 10. However, the feeding unit 4 may include an urging means for pressing a bearing part of the separating roller 10 against the separating pad 11, for example, and may be configured to reduce the urging force generated by the urging means.

What is claimed is:

1. A sheet supplying device comprising:

a sheet accommodating portion that accommodates a plurality of sheets in a stacked arrangement;

a feeding portion disposed to be contactable with a topmost sheet of the plurality of sheets with contact force and rotatable in contact with the topmost sheet for conveying the topmost sheet downstream in a conveying direction;

a shifting mechanism that shifts at least one of the sheet accommodating portion and the feeding portion, thereby changing a position of the feeding portion relative to the plurality of sheets in the sheet accommodating portion;

a first separating portion disposed downstream of the feeding portion in the conveying direction;

a second separating portion disposed downstream of the feeding portion in the conveying direction and disposed to be pressed against the first separating portion, the second separating portion being rotatable to separate the topmost sheet from other sheets of the plurality of sheets in cooperation with the first separating portion and to convey the separated sheet in the conveying direction;

a pressure changing mechanism that changes pressure between the first separating portion and the second separating portion;

a contact force controlling portion that controls the shifting mechanism to provide a first contact force when the feeding portion starts a feeding operation for conveying the topmost sheet in the conveying direction, and that controls the shifting mechanism, at a first timing, to reduce the contact force from the first contact force by separating the feeding portion from the topmost sheet; and a pressure controlling portion that controls the pressure changing mechanism to provide a first pressure between the first separating portion and the second separating portion when the feeding portion starts the feeding operation, and that controls the pressure changing mechanism, at a second timing that is later than the first timing, to reduce the pressure from the first pressure to a second pressure while nipping the separated sheet between the first separating portion and the second separating portion.

2. The sheet supplying device according to claim 1, wherein the contact force controlling portion controls the shifting mechanism to reduce the contact force by separating the feeding portion from the topmost sheet while the topmost sheet is passing between the first separating portion and the second separating portion; and wherein the pressure controlling portion controls the pressure changing mechanism to reduce the pressure while the topmost sheet is passing between the first separating portion and the second separating portion.

3. The sheet supplying device according to claim 1, wherein the feeding portion comprises a feeding roller; and wherein the second separating portion comprises a separating roller that is separate from the feeding roller.

4. The sheet supplying device according to claim 1, further comprising a driving force toggling portion that toggles on and off transfer of a driving force that rotates the second separating portion, the driving force toggling portion stopping the transfer of the driving force after the pressure controlling portion starts an operation to reduce the pressure.

5. The sheet supplying device according to claim 1, further comprising a conveying portion disposed downstream of the first and second separating portions in the conveying direction for receiving the separated sheet and conveying the separated sheet farther downstream in the conveying direction, the conveying portion defining a conveying position, wherein the contact force controlling portion performs an operation to reduce the contact force by separating the feeding portion from the topmost sheet based on a condition that a leading edge of the separated sheet has reached the conveying position.

6. The sheet supplying device according to claim 1, further comprising a conveying portion disposed downstream of the first and second separating portions in the conveying direction for receiving the separated sheet and conveying the separated sheet farther downstream in the conveying direction, the conveying portion defining a conveying position, wherein the pressure controlling portion performs an operation to reduce the pressure based on a condition that a leading edge of the separated sheet has reached the conveying position.

7. The sheet supplying device according to claim 1, further comprising:

an urging member that urges at least one of the first and second separating portions, allowing the first and second separating portions to be pressed against each other, the urging member having: one end disposed at the at least one of the first and second separating portions; and another end opposite the one end;

a driving source that generates driving force; and a gear mechanism that receives the driving force and controls rotation of at least one of the feeding portion and the second separating portion, wherein the pressure changing mechanism comprises a pressing mechanism that can contact the another end of the urging member and can displace the another end of the urging member in an urging direction toward the one end; and wherein the pressure controlling portion comprises a first cam rotatable together with the gear mechanism, the first cam making sliding contact with the pressing mechanism and displacing the pressing mechanism when the first cam rotates.

8. A sheet supplying device comprising:

a sheet accommodating portion that accommodates a plurality of sheets in a stacked arrangement;

a feeding portion disposed to be contactable with a topmost sheet of the plurality of sheets with contact force and rotatable in contact with the topmost sheet for conveying the topmost sheet downstream in a conveying direction;

a shifting mechanism that shifts at least one of the sheet accommodating portion and the feeding portion, thereby changing a position of the feeding portion relative to the plurality of sheets in the sheet accommodating portion;

a first separating portion disposed downstream of the feeding portion in the conveying direction;

a second separating portion disposed downstream of the feeding portion in the conveying direction and disposed to be pressed against the first separating portion, the second separating portion being rotatable to separate the topmost sheet from other sheets of the plurality of sheets in cooperation with the first separating portion and to convey the separated sheet in the conveying direction;

a pressure changing mechanism that changes pressure between the first separating portion and the second separating portion;

a contact force controlling portion that controls the shifting mechanism to provide a first contact force when the feeding portion starts a feeding operation for conveying the topmost sheet in the conveying direction, and that controls the shifting mechanism, at a first timing, to reduce the contact force from the first contact force to a second contact force;

a pressure controlling portion that controls the pressure changing mechanism to provide a first pressure between the first separating portion and the second separating portion when the feeding portion starts the feeding operation, and that controls the pressure changing mechanism, at a second timing, to reduce the pressure from the first pressure to a second pressure while nipping the separated sheet between the first separating portion and the second separating portion, an urging member that urges at least one of the first and second separating portions, allowing the first and second separating portions to be pressed against each other, the urging member having: one end disposed at the at least one of the first and second separating portions; and another end opposite the one end;

a driving source that generates driving force; and a gear mechanism that receives the driving force and controls rotation of at least one of the feeding portion and the second separating portion, wherein the pressure changing mechanism comprises a pressing mechanism that can contact the another end of the urging member and can displace the another end of the urging member in an urging direction toward the one end; and wherein the pressure controlling portion comprises a first cam rotatable together with the gear mechanism, the first cam making sliding contact with the pressing mechanism and displacing the pressing mechanism when the first cam rotates, wherein the pressing mechanism comprises:

a first arm member swingably supported at its substantial center position and having: one end that contacts the another end of the urging member for displacing the another end in the urging direction; and another end opposite the one end with respect to the substantial center position; and a first lever swingably supported at its substantial center position and having: a first end that contacts the another end of the first arm member; and a second end that makes sliding contact with the first cam, allowing the first lever to swing when the first cam rotates.

9. The sheet supplying device according to claim 7, wherein the gear mechanism comprises a gear; and wherein the first cam is provided coaxially with the gear and rotates integrally with the gear.

10. The sheet supplying device according to claim 1, further comprising:

a driving source that generates driving force; and a gear mechanism that receives the driving force and controls rotation of at least one of the feeding portion and the second separating portion, wherein the contact force controlling portion comprises a second cam rotated by the gear mechanism; and wherein the shifting mechanism is contactable with the second cam and displaces, by the rotation of the second cam, at least one of the sheet accommodating portion and the feeding portion, thereby changing the position of the feeding portion relative to the plurality of sheets in the sheet accommodating portion.

11. A sheet supplying device comprising:

a sheet accommodating portion that accommodates a plurality of sheets in a stacked arrangement;

a feeding portion disposed to be contactable with a topmost sheet of the plurality of sheets with contact force and rotatable in contact with the topmost sheet for conveying the topmost sheet downstream in a conveying direction;

a shifting mechanism that shifts at least one of the sheet accommodating portion and the feeding portion, thereby changing a position of the feeding portion relative to the plurality of sheets in the sheet accommodating portion;

a first separating portion disposed downstream of the feeding portion in the conveying direction;

a second separating portion disposed downstream of the feeding portion in the conveying direction and disposed to be pressed against the first separating portion, the second separating portion being rotatable to separate the topmost sheet from other sheets of the plurality of sheets in cooperation with the first separating portion and to convey the separated sheet in the conveying direction;

a pressure changing mechanism that changes pressure between the first separating portion and the second separating portion;

a contact force controlling portion that controls the shifting mechanism to provide a first contact force when the feeding portion starts a feeding operation for conveying the topmost sheet in the conveying direction, and that controls the shifting mechanism, at a first timing, to reduce the contact force from the first contact force to a second contact force;

a pressure controlling portion that controls the pressure changing mechanism to provide a first pressure between the first separating portion and the second separating portion when the feeding portion staffs the feeding operation, and that controls the pressure changing mechanism, at a second timing, to reduce the pressure from the first pressure to a second pressure while nipping the separated sheet between the first separating portion and the second separating portion;

a driving source that generates driving force; and a gear mechanism that receives the driving force and controls rotation of at least one of the feeding portion and the second separating portion, wherein the contact force controlling portion comprises a second cam rotated by the gear mechanism;

wherein the shifting mechanism is contactable with the second cam and displaces, by the rotation of the second cam, at least one of the sheet accommodating portion and the feeding portion, thereby changing the position of the feeding portion relative to the plurality of sheets in the sheet accommodating portion, wherein the shifting mechanism comprises:

a second arm member swingably supported at its substantial center position and having: one end connected with the feeding portion for changing the position of the feeding portion; and another end opposite the one end with respect to the substantial center position; and a second lever swingably supported at its substantial center position and having: a first surface that contacts the another end of the second arm member; and a second surface that makes sliding contact with the second cam, allowing the second lever to swing when the second cam rotates.

12. The sheet supplying device according to claim 10, wherein the gear mechanism comprises a gear; and wherein the second cam is provided coaxially with the gear and rotates integrally with the gear.

13. An image forming apparatus comprising:

a sheet supplying device comprising:

a sheet accommodating portion that accommodates a plurality of sheets in a stacked arrangement;

a feeding portion disposed to be contactable with a topmost sheet of the plurality of sheets with contact force and rotatable in contact with the topmost sheet for conveying the topmost sheet downstream in a conveying direction;

a shifting mechanism that shifts at least one of the sheet accommodating portion and the feeding portion, thereby changing a position of the feeding portion relative to the plurality of sheets in the sheet accommodating portion;

a first separating portion disposed downstream of the feeding portion in the conveying direction;

a second separating portion disposed downstream of the feeding portion in the conveying direction and disposed to be pressed against the first separating portion, the second separating portion being rotatable to separate the topmost sheet from other sheets of the plurality of sheets in cooperation with the first separating portion and to convey the separated sheet in the conveying direction;

a pressure changing mechanism that changes pressure between the first separating portion and the second separating portion;

a contact force controlling portion that controls the shifting mechanism to provide a first contact force when the feeding portion starts a feeding operation for conveying the topmost sheet in the conveying direction, and that controls the shifting mechanism, at a first timing, to reduce the contact force from the first contact force by separating the feeding portion from the topmost sheet; and a pressure controlling portion that controls the pressure changing mechanism to provide a first pressure between the first separating portion and the second separating portion when the feeding portion starts the feeding operation, and that controls the pressure changing mechanism, at a second timing that is later than the first timing, to reduce the pressure from the first pressure to a second pressure while nipping the separated sheet between the first separating portion and the second separating portion; and an image forming unit that forms an image on the sheet supplied from the sheet supplying device.

14. The sheet supplying device according to claim 1, wherein the feeding portion comprises a feeding roller;

wherein the second separating portion comprises a separating roller that is separate from the feeding roller;

wherein the shifting mechanism shifts the feeding roller, thereby changing the position of the feeding roller relative to the plurality of sheets in the sheet accommodating portion;

wherein the contact force controlling portion controls the shifting mechanism to separate the feeding roller from the plurality of sheets in the sheet accommodating portion while the topmost sheet is passing between the first separating portion and the separating roller; and wherein the pressure controlling portion controls the pressure changing mechanism to reduce the pressure while the topmost sheet is passing between the first separating portion and the separating roller and after the feeding roller is separated from the plurality of sheets in the sheet accommodating portion.

15. The image forming apparatus according to claim 13, wherein the feeding portion comprises a feeding roller;

wherein the second separating portion comprises a separating roller that is separate from the feeding roller;

wherein the shifting mechanism shifts the feeding roller, thereby changing the position of the feeding roller relative to the plurality of sheets in the sheet accommodating portion;

wherein the contact force controlling portion controls the shifting mechanism to separate the feeding roller from the plurality of sheets in the sheet accommodating portion while the topmost sheet is passing between the first separating portion and the separating roller; and wherein the pressure controlling portion controls the pressure changing mechanism to reduce the pressure while the topmost sheet is passing between the first separating portion and the separating roller and after the feeding roller is separated from the plurality of sheets in the sheet accommodating portion.

* * * * *